US010478693B2

(12) United States Patent
Solheim et al.

(10) Patent No.: US 10,478,693 B2
(45) Date of Patent: Nov. 19, 2019

(54) HEADCOVERS HAVING A PULL STRAP AND METHODS FOR MANUFACTURING THE SAME

(71) Applicant: KARSTEN MANUFACTURING CORPORATION, Phoenix, AZ (US)

(72) Inventors: John A. Solheim, Phoenix, AZ (US); John R. Marusiak, Phoenix, AZ (US); Xiaojian Chen, Phoenix, AZ (US); Daniel K. Lee, Chandler, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/847,733

(22) Filed: Dec. 19, 2017

(65) Prior Publication Data

US 2018/0104557 A1 Apr. 19, 2018

Related U.S. Application Data

(62) Division of application No. 15/380,884, filed on Dec. 15, 2016, now Pat. No. 9,868,040, which is a division of application No. 14/491,318, filed on Sep. 19, 2014, now Pat. No. 9,561,414.

(60) Provisional application No. 61/880,778, filed on Sep. 20, 2013, provisional application No. 61/883,985, filed on Sep. 27, 2013, provisional application No. 61/888,962, filed on Oct. 9, 2013.

(51) Int. Cl.

| | |
|---|---|
| ***A63B 60/64*** | (2015.01) |
| ***A63B 60/62*** | (2015.01) |
| *A63B 43/00* | (2006.01) |

(52) U.S. Cl.
CPC ..... *A63B 60/64* (2015.10); *A63B 60/62* (2015.10); *A63B 43/005* (2013.01); *A63B 2209/08* (2013.01); *Y10T 29/49* (2015.01)

(58) Field of Classification Search
CPC ..... A63B 55/007; A63B 55/404; A63B 60/64
USPC ..... 150/160
See application file for complete search history.

(56) References Cited

U.S. PATENT DOCUMENTS

| | | | | |
|---|---|---|---|---|
| 2,128,546 A | | 8/1938 | Venmore | |
| 2,508,525 A | | 5/1950 | Le Fevre | |
| 2,879,819 A | | 3/1959 | Turnbull | |
| 3,023,795 A | | 3/1962 | Denkert | |
| 3,460,207 A | | 8/1969 | Stewart | |
| 3,593,769 A | | 7/1971 | Spears | |
| 3,603,368 A | | 9/1971 | Brenner | |
| 3,638,284 A | | 2/1972 | Baker | |
| 3,664,399 A | | 5/1972 | Neff | |
| 3,924,872 A | * | 12/1975 | Sollazzi | A45C 13/262 190/18 A |
| 4,195,677 A | | 4/1980 | Hagg et al. | |
| 5,000,238 A | | 3/1991 | Zeller | |

(Continued)

FOREIGN PATENT DOCUMENTS

| | | |
|---|---|---|
| CA | 2254316 | 5/2000 |
| GB | 2404595 | 2/2005 |

(Continued)

*Primary Examiner* — Sue A Weaver

(57) ABSTRACT

Embodiments of headcovers having a headcover body that includes a detachable pull strap with a plurality of leg portions that connect to the headcover body and methods to manufacture such headcovers are generally described herein. Other embodiments of the headcovers may be described and claimed.

5 Claims, 35 Drawing Sheets

(56) References Cited

U.S. PATENT DOCUMENTS

| | | | | |
|---|---|---|---|---|
| 5,403,009 | A * | 4/1995 | Gleason, Jr. | A63B 69/3638 150/160 |
| 5,437,320 | A | 8/1995 | Sung | |
| 5,522,592 | A * | 6/1996 | Evelsizer, Jr. | A63B 60/64 150/160 |
| 5,690,559 | A | 11/1997 | Julius | |
| 5,779,042 | A | 7/1998 | Kaneko | |
| 6,298,987 | B1 | 10/2001 | Clark | |
| 6,716,111 | B2 | 4/2004 | Liberatore | |
| 7,188,647 | B2 | 3/2007 | Bradshaw | |
| 7,584,844 | B2 | 9/2009 | Kvinge et al. | |
| D603,473 | S | 11/2009 | Templeton | |
| 7,686,049 | B2 | 3/2010 | Hwang | |
| 7,721,884 | B2 | 5/2010 | Kvinge et al. | |
| 8,245,362 | B2 * | 8/2012 | Blevins | A63B 60/62 150/160 |
| 8,714,216 | B2 | 5/2014 | Hooley | |
| 8,800,614 | B2 | 8/2014 | Loudenslager et al. | |
| 8,905,094 | B2 | 12/2014 | Gaffney | |
| 2003/0056866 | A1 * | 3/2003 | Sheppard, Jr. | A45C 3/12 150/160 |
| 2003/0075252 | A1 | 4/2003 | Noyes | |
| 2004/0144460 | A1 | 7/2004 | German | |
| 2007/0068611 | A1 | 3/2007 | Hwang | |
| 2007/0158219 | A1 | 7/2007 | Simone | |
| 2007/0261772 | A1 | 11/2007 | Chow | |
| 2008/0105343 | A1 | 5/2008 | Noyes | |
| 2008/0230159 | A1 | 9/2008 | Tan | |
| 2008/0264534 | A1 | 10/2008 | Carey | |
| 2013/0160908 | A1 | 6/2013 | Oliveiro | |
| 2014/0338223 | A1 * | 11/2014 | Adams | A43C 11/14 36/50.1 |
| 2015/0076018 | A1 | 3/2015 | Lee | |
| 2017/0216693 | A1 * | 8/2017 | Gaffney | A63B 60/62 |

FOREIGN PATENT DOCUMENTS

| | | |
|---|---|---|
| JP | 2001137406 | 5/2001 |
| JP | 2009101103 | 5/2009 |
| JP | 2009273748 | 11/2009 |
| KR | 1020090035922 | 4/2009 |
| KR | 101212530 | 1/2013 |
| WO | 9746289 | 12/1997 |

* cited by examiner

HEADCOVERS HAVING A PULL STRAP AND METHODS FOR MANUFACTURING THE SAME

CROSS REFERENCE TO RELATED APPLICATIONS

This application is a divisional of U.S. patent application Ser. No. 15/380,884, filed Dec. 15, 2016, which is a division of U.S. patent application Ser. No. 14/491,318, filed Sep. 19, 2014—now U.S. Pat. No. 9,561,414—which claims benefit of U.S. provisional application Ser. No. 61/880,778 filed on Sep. 20, 2013, U.S. provisional application Ser. No. 61/883,985 filed on Sep. 27, 2013, and U.S. provisional application Ser. No. 61/888,962 filed on Oct. 9, 2013, which are herein incorporated by reference in their entirety.

FIELD

The present document generally relates to headcovers for golf clubs, and in particular, to headcovers having a collapsible configuration.

BACKGROUND

Golf headcovers are used to store and protect a club head when the golf club is not being used. As such, headcovers usually have a fixed non-collapsible configuration having an interior portion configured to receive the club head therein. However, headcovers with a fixed non-collapsible configuration may form permanent creases along the headcover body as a result of being stored for long periods of time in a confined storage space after manufacture.

BRIEF DESCRIPTION OF THE DRAWINGS

Corresponding reference characters indicate corresponding elements among the view of the drawings. The headings used in the figures do not limit the scope of the claims.

DESCRIPTION

Figure 6:
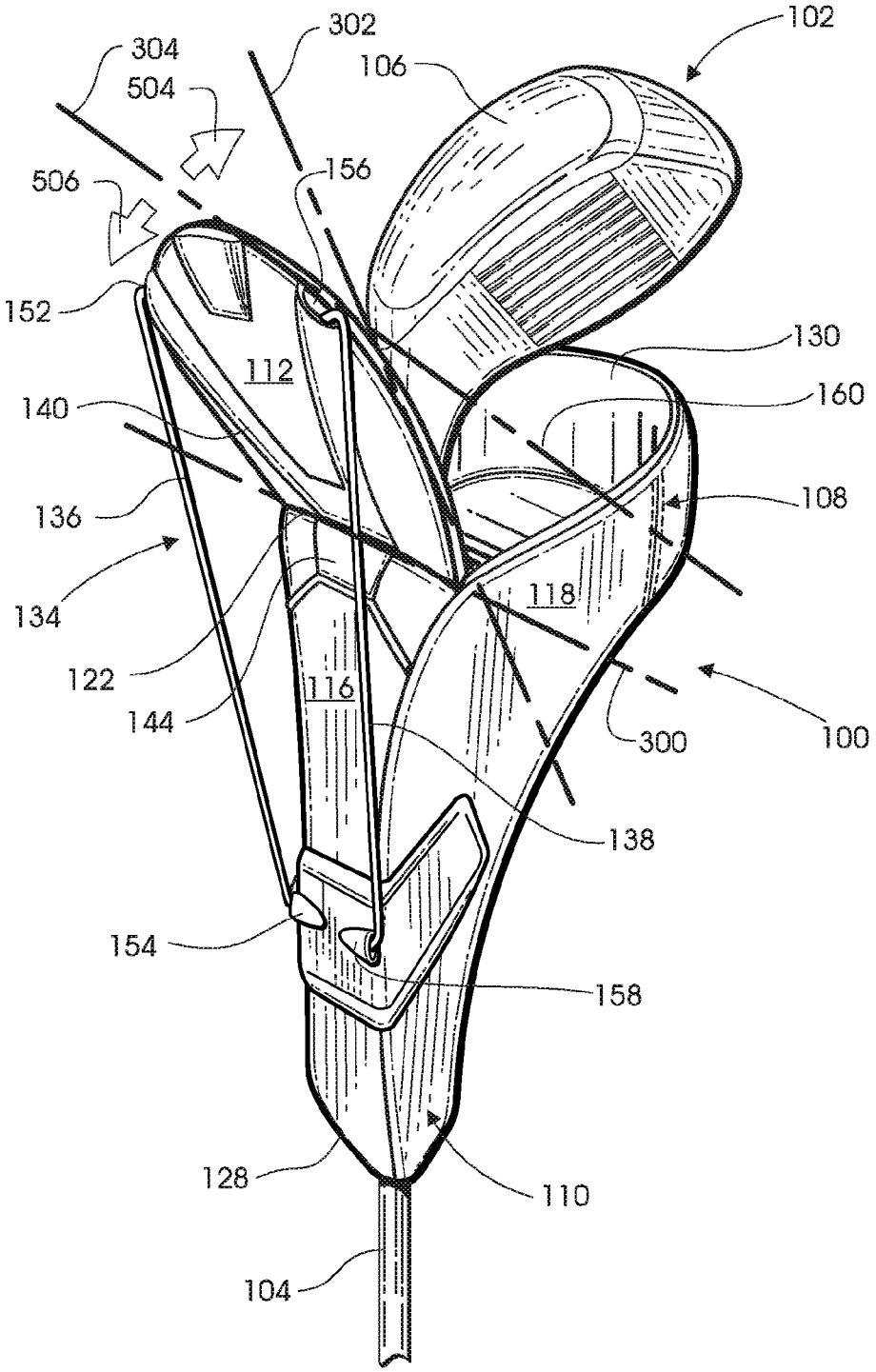
FIG. 6 is perspective view of the top loading headcover of FIG. 1 shown in the open position.

Embodiments of headcovers and methods of manufacturing such headcovers are disclosed herein. Referring to the drawings, embodiments of headcovers are illustrated and generally indicated as 100, 200, 600, 700, and 1200 in FIGS. 1-37. As shown in FIGS. 1-5, one embodiment of a top loading headcover, designated 100, may include a headcover body 101 having a belly panel 114, a back panel 116, a first side panel 118 and a second side panel 120 that collectively define a lower portion 110 forming a proximal opening 128 and an upper portion 108 forming a distal opening 130 (FIG. 6). Referring to FIG. 6, the proximal opening 128 and the distal opening 130 directly communicate with an interior portion 160 of the headcover 100 that is configured to receive a club head 106 and a portion of a club shaft 104 of a golf club 102. In addition, as shown in FIGS. 1 and 3-6, a top shroud 112 is connected to the back panel 116 through a hinge point 122 that allows the top shroud 112 to be rotated along an axis 300 (FIGS. 3 and 6) between a closed position when the top shroud 112 contacts the upper portion 108 of the headcover body 101 for closing off the distal opening 130 and an open position when the top shroud 112 no longer contacts the upper portion 108 of the headcover body 101 for opening up the distal opening 130. In some embodiments, the hinge point 122 may define a dividing line between the top shroud 112 and the back panel 116 that is configured to permit rotation of the top shroud 112 relative to the back panel 116.

Figure 1:
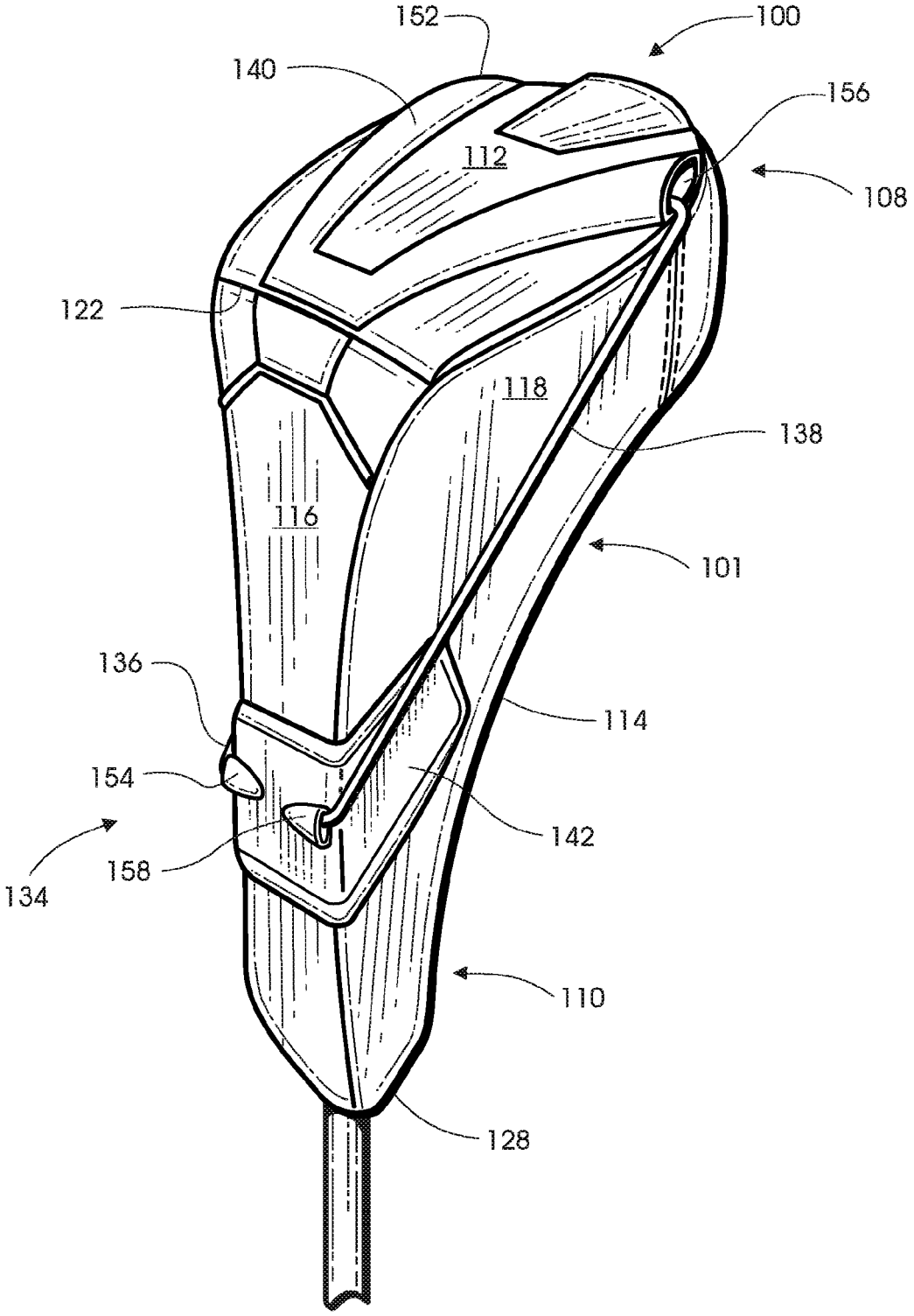
FIG. 1 is perspective view of a first embodiment of a top loading headcover shown in the closed position.
Figure 2:
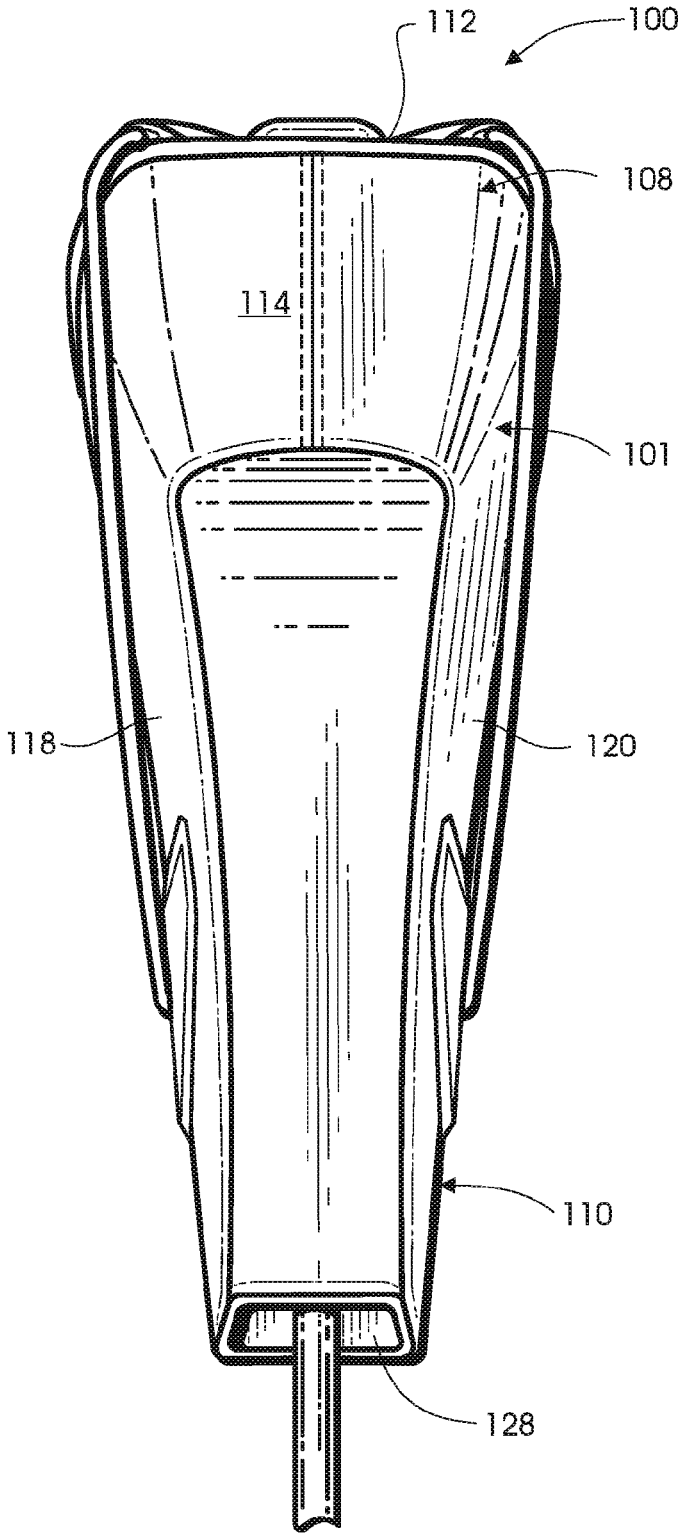
FIG. 2 is a front view of the top loading headcover of FIG. 1.
Figure 3:
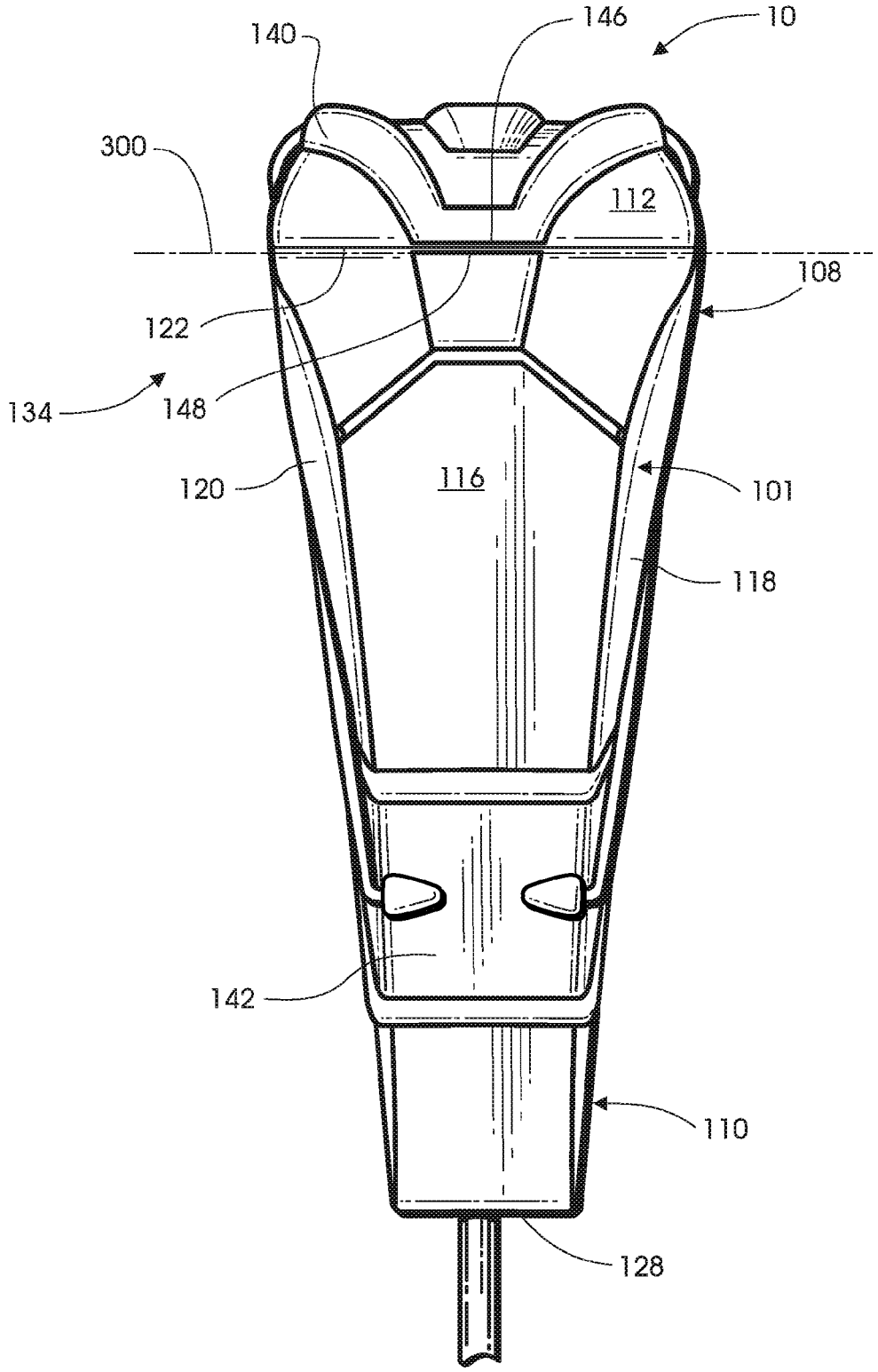
FIG. 3 is a rear view of the top loading headcover of FIG. 1.

As further shown in FIG. 6, when the top shroud 112 is placed in the open position by an individual a biasing mechanism 134 engaged to the headcover body 101 biases the top shroud 112 into the open position and maintains the top shroud 112 in the open position until the individual physically rotates the top shroud 112 back into the closed position. Referring to FIGS. 1 and 6, in one embodiment, the biasing mechanism 134 may include a first elastic member 136 that is connected to the top shroud 112 at a first anchor point 152 and the back panel 116 at a second anchor point 154. Similarly, a second elastic member 138 may be connected to the top shroud 112 at a third anchor point 156 and the back panel 116 at a fourth anchor point 158. In some embodiments, the first, second, third and fourth anchor points 152, 154, 156 and 158 may be securing points configured to receive and engage the first and second elastic members 136 and 138, respectively, to the top shroud 112 and back panel 116, respectively. In one arrangement shown in FIGS. 4 and 5, the first elastic member 136 extends along the first side panel 118 between the top shroud 112 and the back panel 116, while the second elastic member 138 extends along the second side panel 120 between the top shroud 112 and the back panel 116 when the top shroud 112 is in the closed position. Referring back to FIG. 1 in some embodiments, the top shroud 112 may include a first molded member 140 that is configured to engage the first and second elastic members 136 and 138, respectively, at first and third anchor points 152 and 156, while the back panel 116 may include a second molded member 142 configured to engage the opposite ends of the first and second elastic members 136 and 138, respectively, at the second and fourth anchor points 154 and 158, respectively. In some embodiments, the first and second elastic members 136 and 138 may be a bungee cord that applies a spring force when stretched; however, other types of elastic members may be used, such as a wire, an elastic synthetic or organic material, and/or spring that generate a spring force when a bias is applied.

Figures 4, 19:
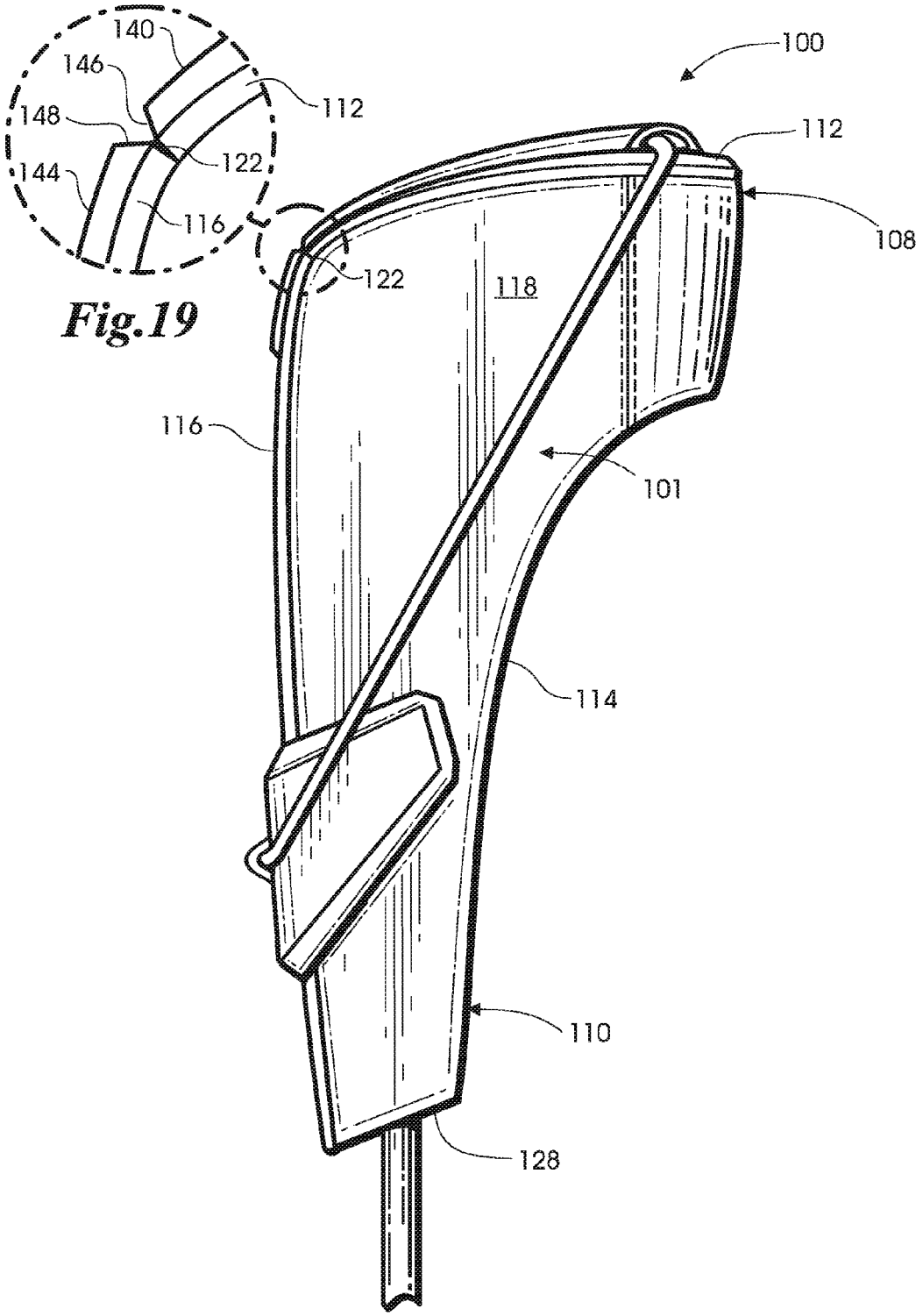
FIG. 4 is a side view of the top loading headcover of FIG. 1.
FIG. 19 is an enlarged view of the first and second stop members shown in FIG. 4.
Figure 5:
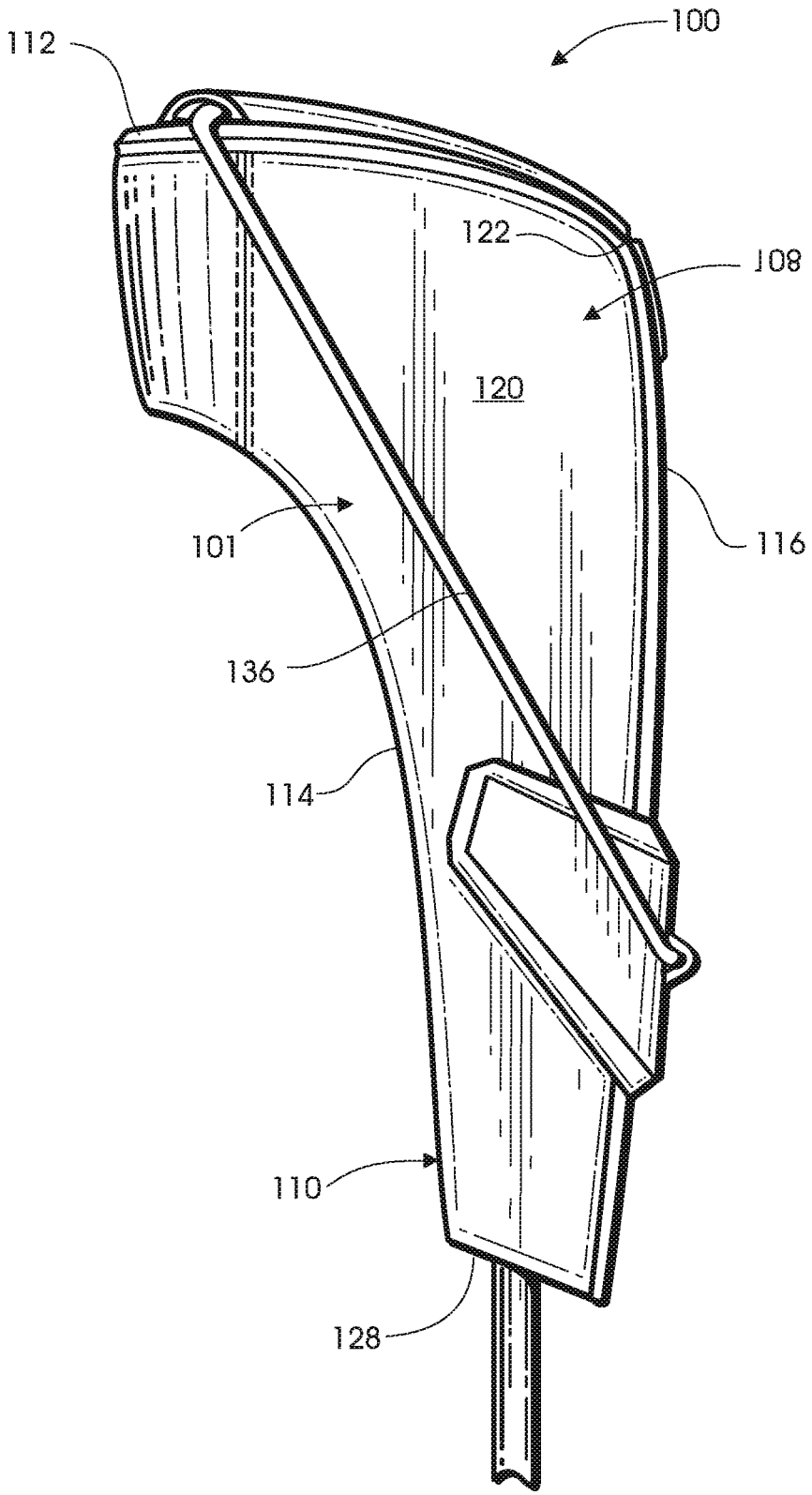
FIG. 5 is an opposite side view of the top loading headcover of FIG. 1.

Referring back to FIG. 3 the biasing mechanism 134 further includes a first stop portion 146 and a second stop portion 148 for providing a means of preventing further rotation of the top shroud 112 by the first and second elastic members 136 and 138 when the top shroud 112 is being placed in the open position as shown in FIG. 6. In addition, the first stop portion 146 is formed on a first molded member 140 located on the top shroud 112 and the second stop portion 148 is formed on a third molded member 144 located on the back panel 116. Referring to FIG. 19, In some embodiments, the first and second stop portions 146 and 148 define respective flat angled contact surfaces that prevent further rotation of the top shroud 112 when top shroud 112 is placed in the open position as the flat angled contact surface of the first stop portion 146 contacts in substantially flush engagement with the flat angled contact surface of the second stop portion 148. This arrangement allows the top shroud 112 to be maintained in a biased open position until an individual forces the top shroud 112 back into the closed position.

In order to place the top shroud 112 in the open position, an individual lifts the top shroud 112 in a direction that exposes the distal opening 130 of the headcover 100 as illustrated by directional arrow 506 (FIG. 6). In the open position, an individual may either insert the golf club 102 through the upper portion 108 of the headcover 100 or retrieve the golf club 102 from the upper portion 108 of the headcover 100 such that the club head 106 never passes through the proximal opening 128 of the headcover 100. As the top shroud 112 is rotated from the closed position to the open position, the top shroud 112 passes an equilibrium point 302 (FIG. 6) that allows the bias applied by the first and second elastic members 136 and 138 to be applied to top shroud 112 in order maintain the top shroud 112 in the open position along axis 304 (FIG. 6) when the first and second stop portions 146 and 148 engage each other and prevent further rotation of the top shroud 112 in the open position.

Conversely, an individual may close the headcover 100 by rotating the top shroud 112 in direction 504 (FIG. 6) that closes off the distal opening 130. When the top shroud 112 rotates back through the equilibrium point 302, the first and second elastic members 136 and 138 bias the top shroud 112 back to the closed position (FIG. 1).

Figure 7:
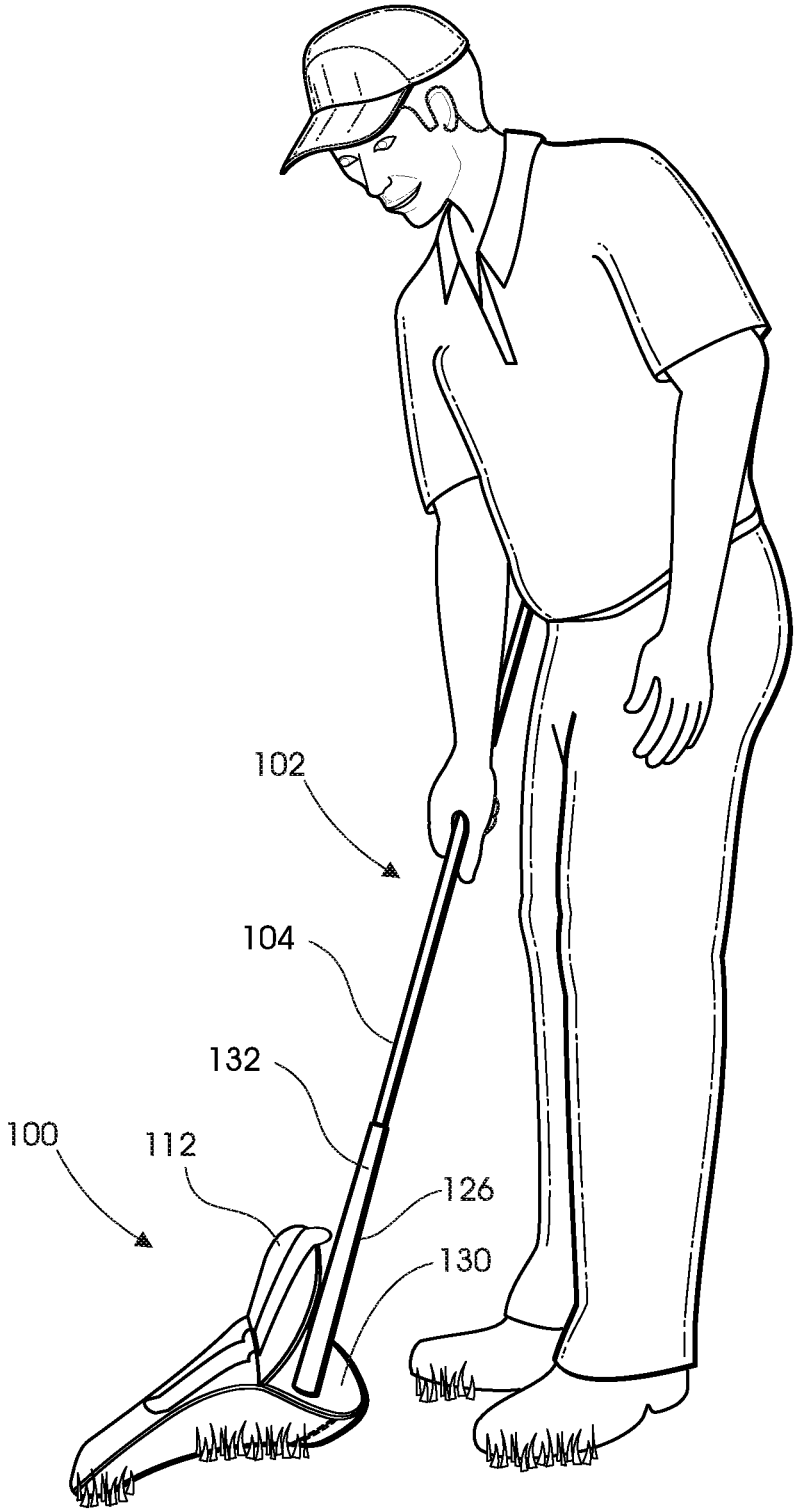
FIGS. 7-10 illustrate one method of using the top loading headcover of FIG. 1 with a golf club.
Figure 8:
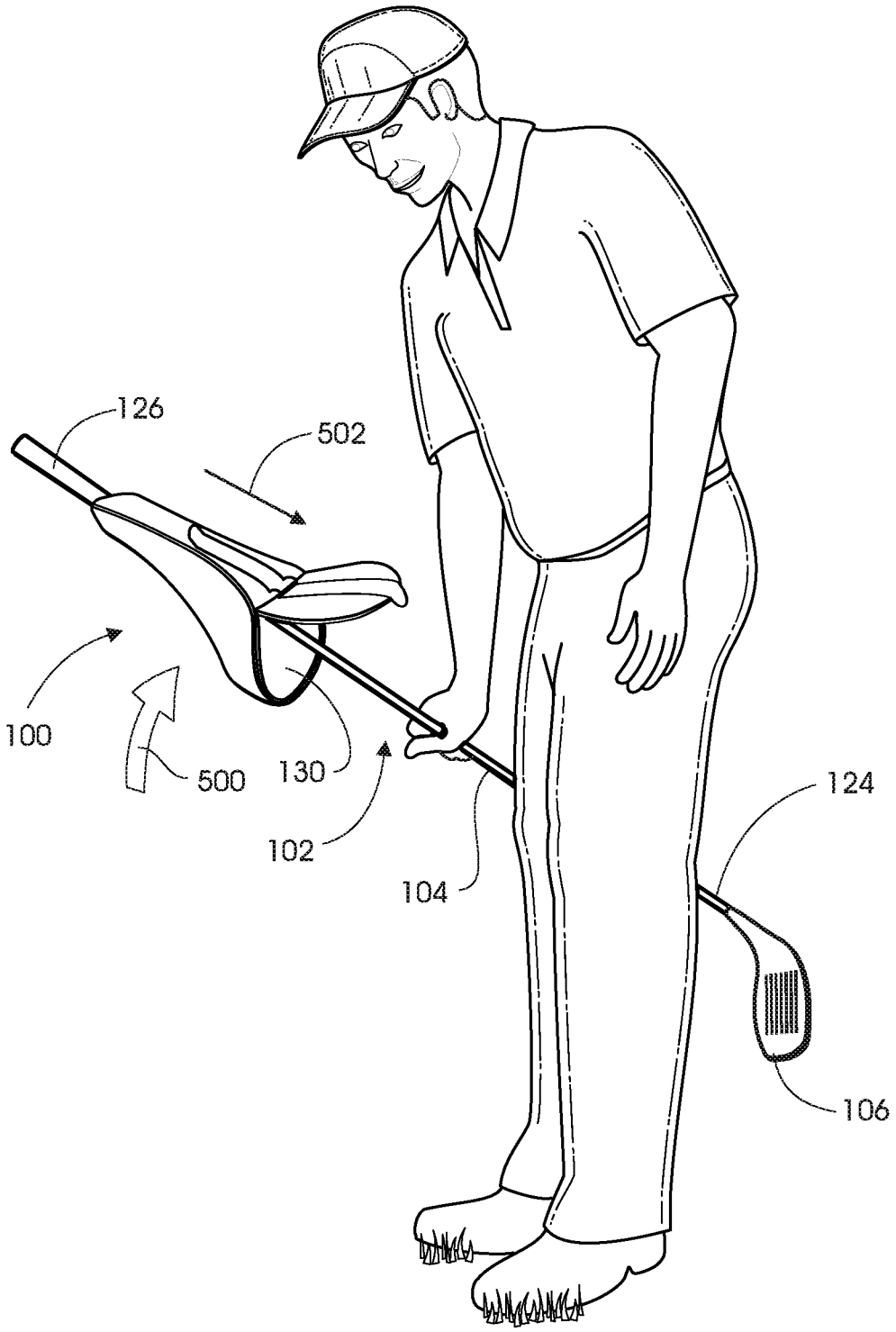
Figure 9:
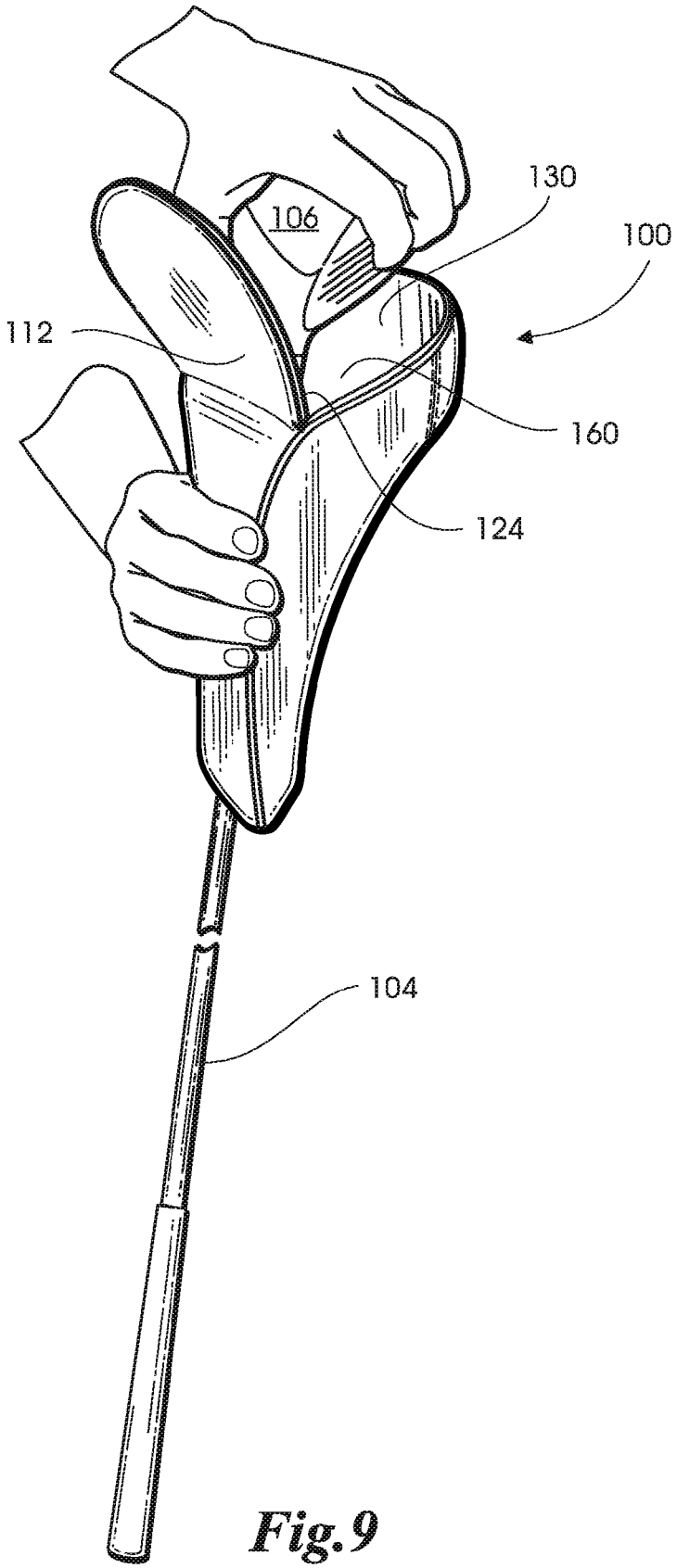
Figure 10:
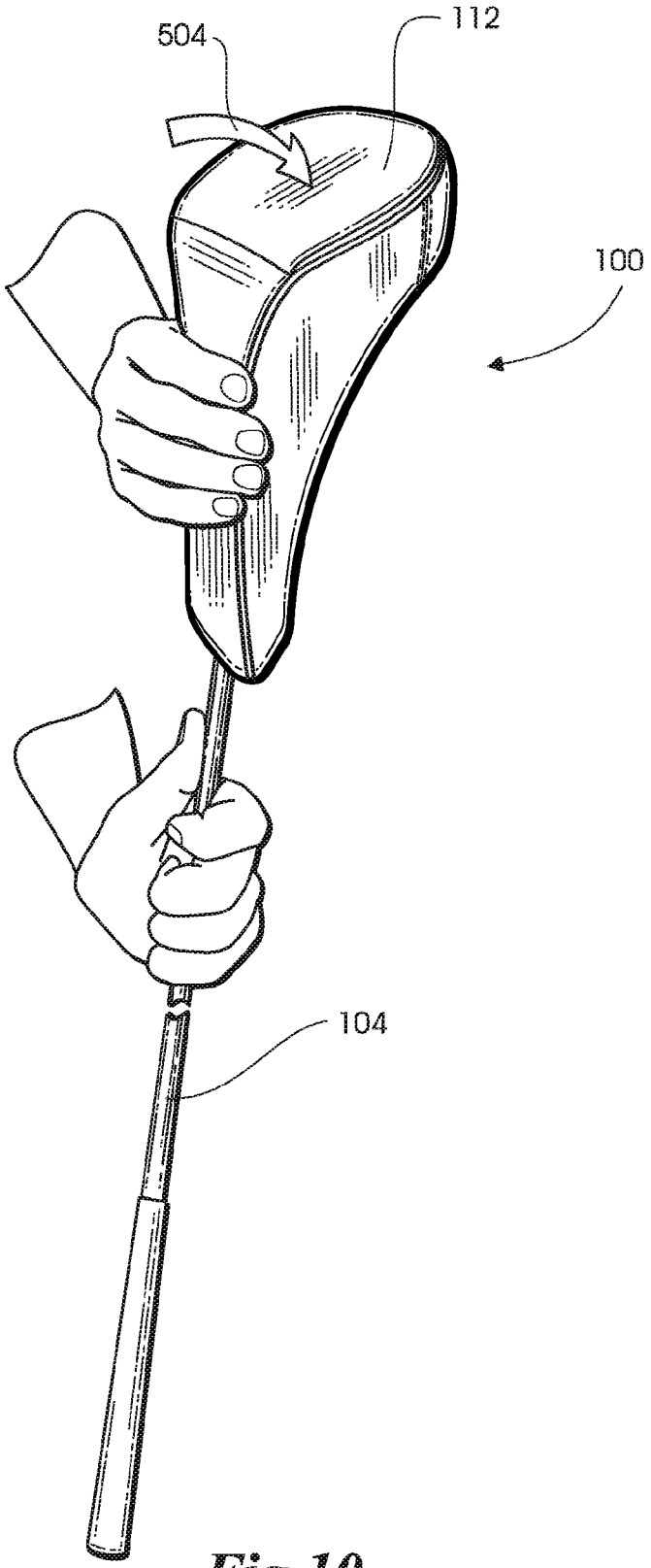

FIGS. 7-10 illustrate a sequence of steps for performing one method of storing the golf club 102 in the headcover 100. As shown in FIG. 7, after removing the golf club 102 from the headcover 100 and using the golf club 102 an individual may insert the proximal end 126 of the club shaft 104 (e.g., the end of the club shaft 104 having the grip 132) through the distal opening 130 of headcover 100 with the top shroud 112 in the open position. This insertion action may be accomplished when the headcover 100 is on the ground such that the individual does not have to substantially lean over and pick up the headcover 100 from the ground in order to store the golf club 102, but may stand substantially upright when performing the steps of the method. Referring to FIG. 8, once the individual inserts the golf club 102 into the distal opening 130, the club shaft 102 may then be oriented in a substantially upward direction 500 relative to the ground such that the headcover 100 slides downward along the club shaft 104 from the distal end 124 of the club shaft 104 towards the proximal end 126 of the club shaft 104 in direction 502 by force of gravity until the headcover 100 reaches the distal end 124 of the club shaft 104 proximate the club head 106. Referring to FIG. 9, once the headcover 100 reaches the distal end 124 of the club shaft 104 the club head 106 can be passed through the distal opening 130 and disposed within the interior portion 160 of the headcover 100. Once the club head 106 is fully disposed within the headcover 100, the individual rotates the top shroud 112 in the closed position as illustrated by direction 504 to close off the distal opening 130 and encase the club head 106 and a portion of the club shaft 104 within interior portion 160 of the headcover 100 as shown in FIG. 10.

Figure 11:
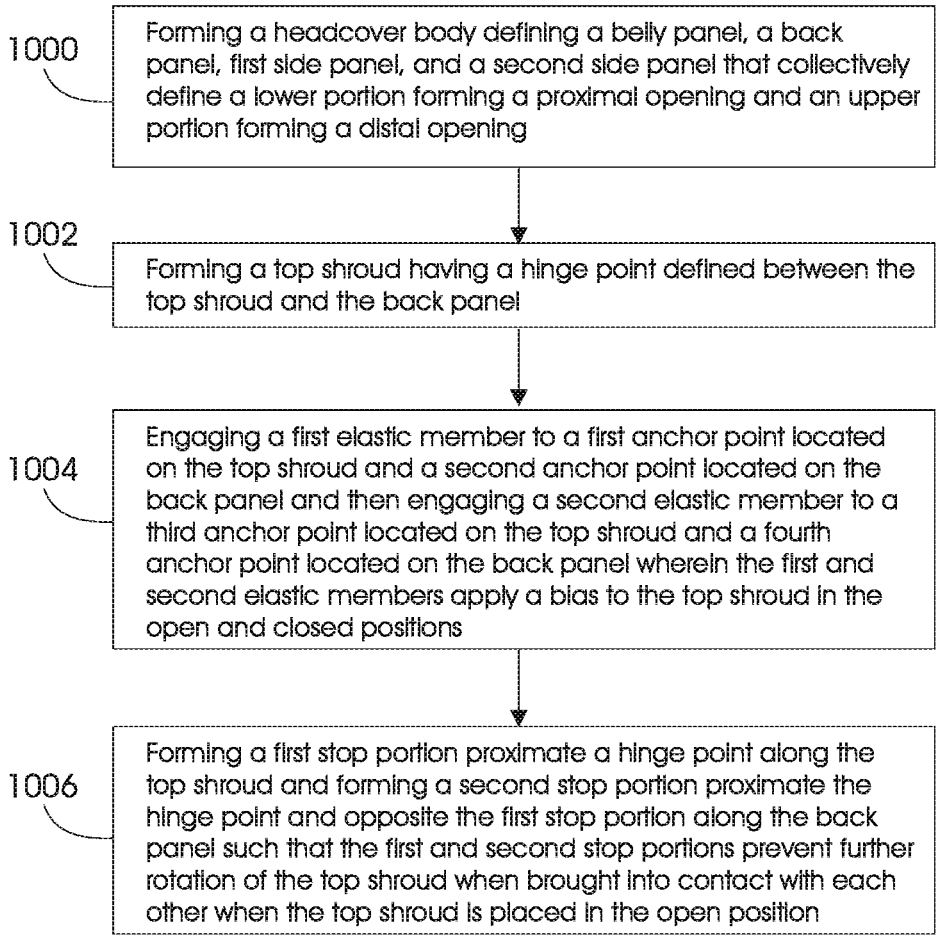
FIG. 11 is a flow chart illustrating one method for manufacturing the top loading headcover of FIG. 1.

Referring to FIG. 11, one method for manufacturing the headcover 100 is illustrated. At block 1000, forming a headcover body 101 defining a belly panel 114, a back panel 116, a first side panel 118 and a second side panel 120 that collectively define a lower portion 110 forming a proximal opening 128 and an upper portion 108 forming a distal opening 130. At block 1002, forming a top shroud 112 having a hinge point 122 defined between the top shroud 112 and the back panel 116. At block 1004, engaging a first elastic member 136 to a first anchor point 152 located on the top shroud 112 and a second anchor point 154 located on the back panel 116 and then engaging a second elastic member 138 to a third anchor point 156 located on the top shroud 112 and a fourth anchor point located on the back panel 116, wherein the first and second elastic members 136 and 138 apply a bias to the top shroud 112 in the open and closed positions. At block 1006, forming a first stop portion 146 proximate the hinge point 122 along the top shroud 112 and then forming a second stop portion 148 proximate the hinge point 122 and opposite the first stop portion 148 along the back panel 116 such that the first and second stop portions 146 and 148 prevent further rotation of the top shroud 112 when brought into contact with each other as the top shroud 112 is being placed in the open position.

While a particular order of actions is illustrated in FIG. 11, these actions may be performed in other temporal sequences. For example, two or more actions depicted in FIG. 11 may be performed sequentially, concurrently, or simultaneously. Alternatively, two or more actions depicted may be performed in reverse order. Further one or more actions in FIG. 11 may not be performed at all. The apparatus, methods, and articles of manufacture described herein are not limited in this regard.

Figure 17:
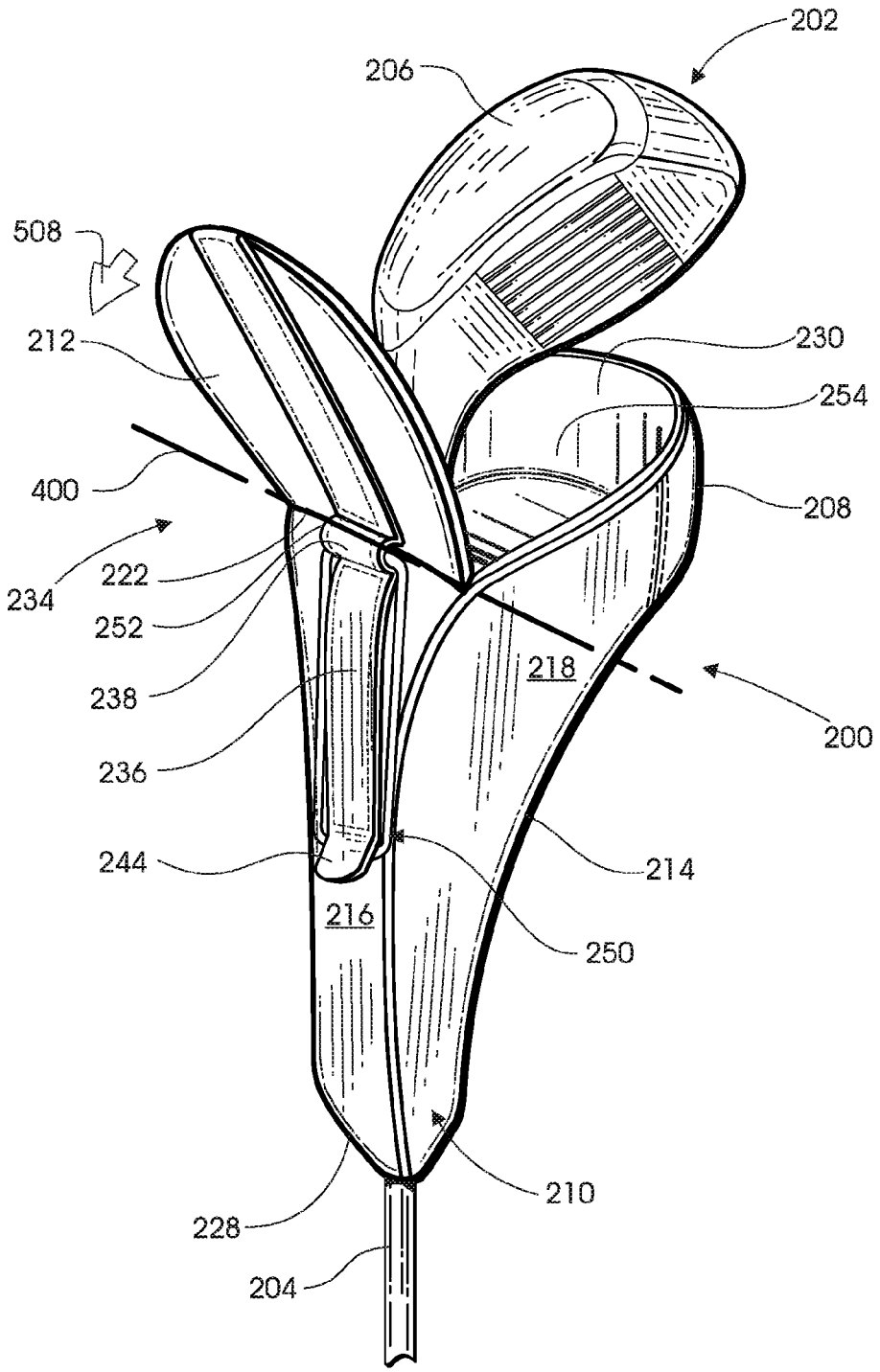
FIG. 17 is a perspective view of the top loading headcover of FIG. 12 shown in the open position.

Referring to FIGS. 12-17, another embodiment of the top loading headcover, designated 200, may include a headcover body 201 having a belly panel 214, a back panel 216, a first side panel 218 and a second side panel 220 that collectively define a lower portion 210 having a proximal opening 228 and collectively define an upper portion 208 having a distal opening 230 (FIG. 17). Referring to FIG. 17, the proximal opening 228 and the distal opening 230 directly communicate with an interior portion 254 formed by the headcover body 201 that is configured to receive therein a golf club 202, and in particular the club head 206 and a portion of the club shaft 204. In addition, a top shroud 212 is connected to the back panel 216 through a hinge point 222 that allows the top shroud 212 to be rotated along an axis 400 between a closed position when the top shroud 212 no longer contacts the upper portion 208 of the headcover body 201, thereby preventing communication with the distal opening 230 and an open position when the top shroud 212 no longer contacts the upper portion 208 of the headcover body 201, thereby allowing communication with the distal opening 230. In some embodiments, the hinge point 222 defines a dividing line between the top shroud 212 and the back panel 216 that is configured to permit rotation of the top shroud 212 relative to the back panel 216 between the open and closed positions.

Referring back to FIGS. 12-16, the headcover 200 further includes a biasing mechanism 234 engaged to the headcover body 201 that securely maintains the top shroud 212 in either a closed position such that communication with the distal opening 230 is prevented or an open position such that communication with the distal opening 230 (FIG. 17) is permitted. In one embodiment, the biasing mechanism 234 includes a webbing strip 236 that extends along the upper portion 208 of the headcover body 201 from top shroud 212 to the back panel 216, while a distal hook portion 242 is defined along the upper portion 208 of the first and second side panels 218 and 220 proximate the distal opening 230. The webbing strip 236 defines a distal hook portion 242 (FIGS. 13 and 15-17) formed proximate the upper portion 208 of the first and second side panels 218 and 220 and a proximal hook portion 244 (FIGS. 12 and 14-17) formed proximate the back panel 216. As shown, the webbing strip 236 collectively forms a channel 238 with the top shroud 212 approximately midway along the length of the webbing strip 236. In addition, the webbing strip 236 may be positioned on the upper portion 208 of the headcover body 201 along the top shroud 212 such that the channel 238 is located proximate the hinge point 216. The apparatus, methods and articles of manufacture are not limited in this regard.

Figure 12:
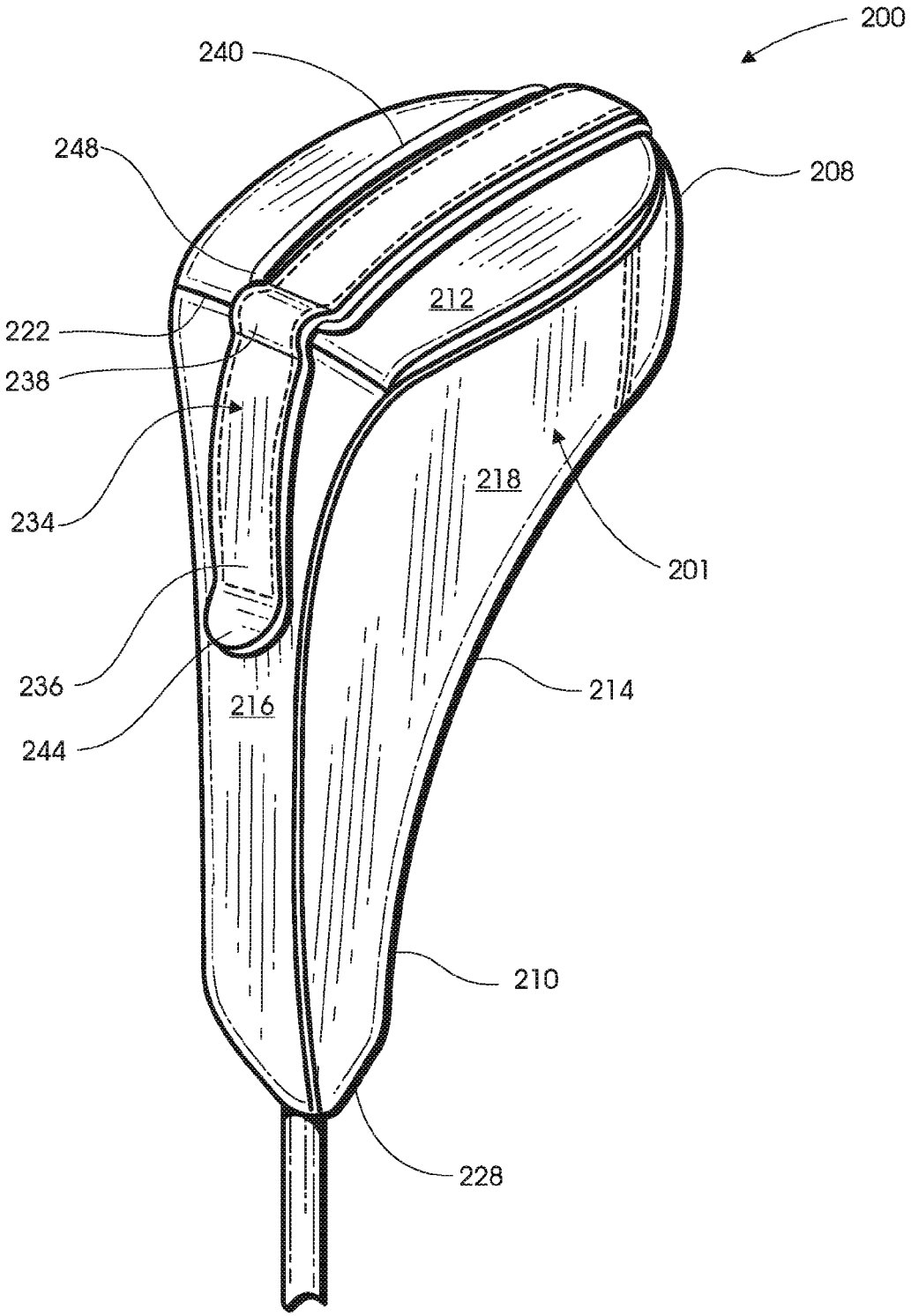
FIG. 12 is a perspective view of a second embodiment of the top loading headcover shown in a closed position.
Figure 13:
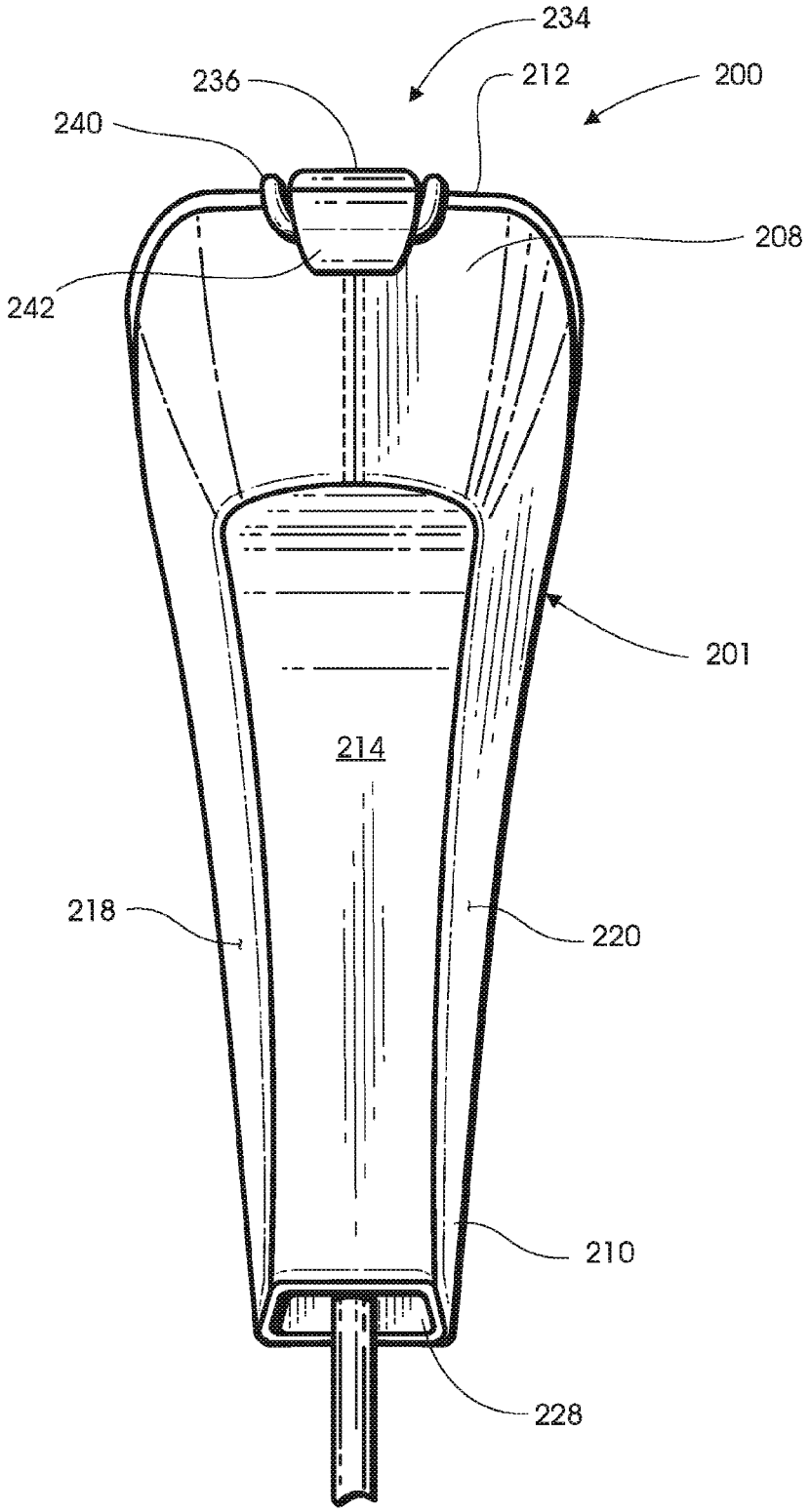
FIG. 13 is a front view of the top loading headcover of FIG. 12.
Figure 14:
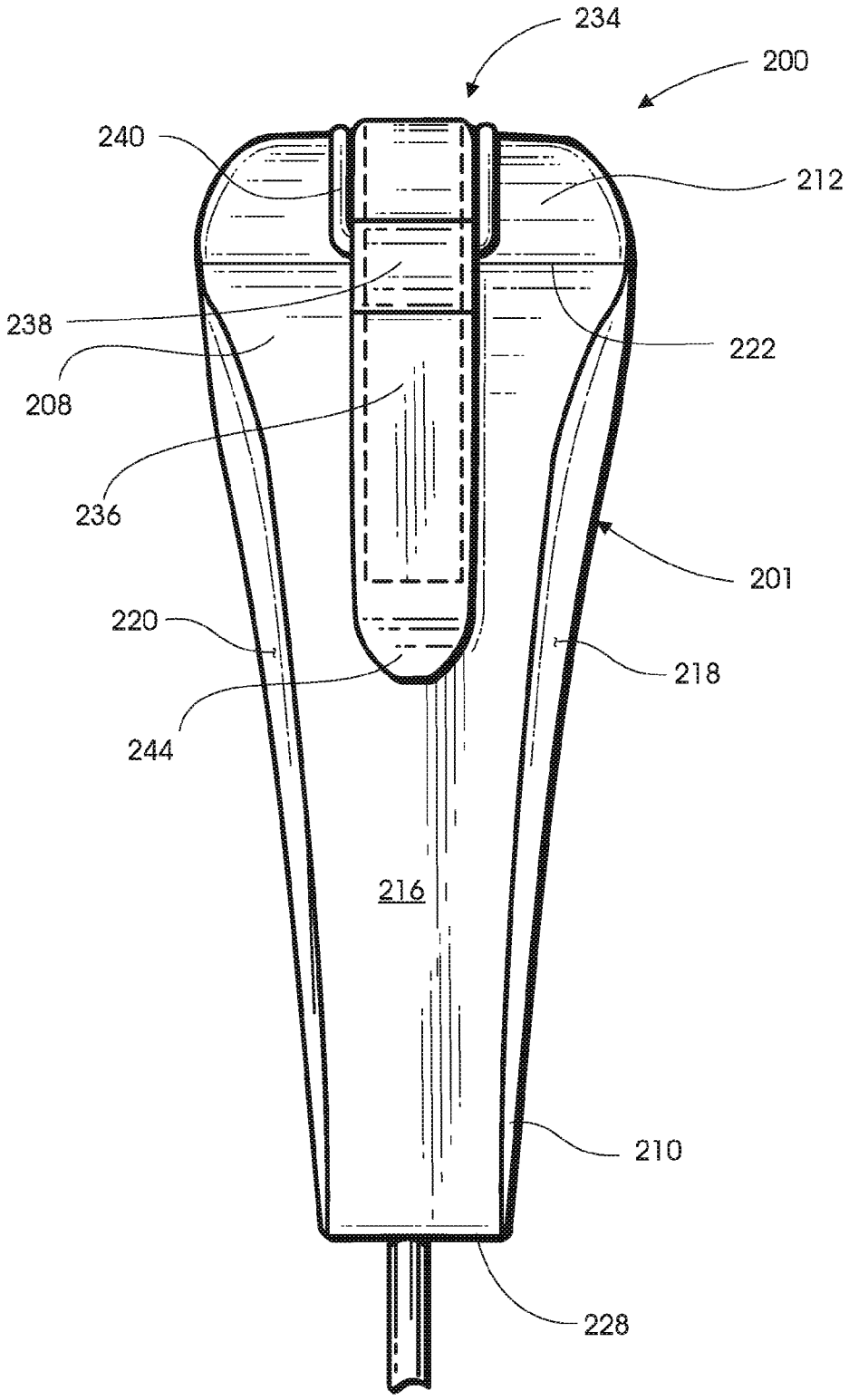
FIG. 14 is a rear view of the top loading headcover of FIG. 12.
Figure 15:
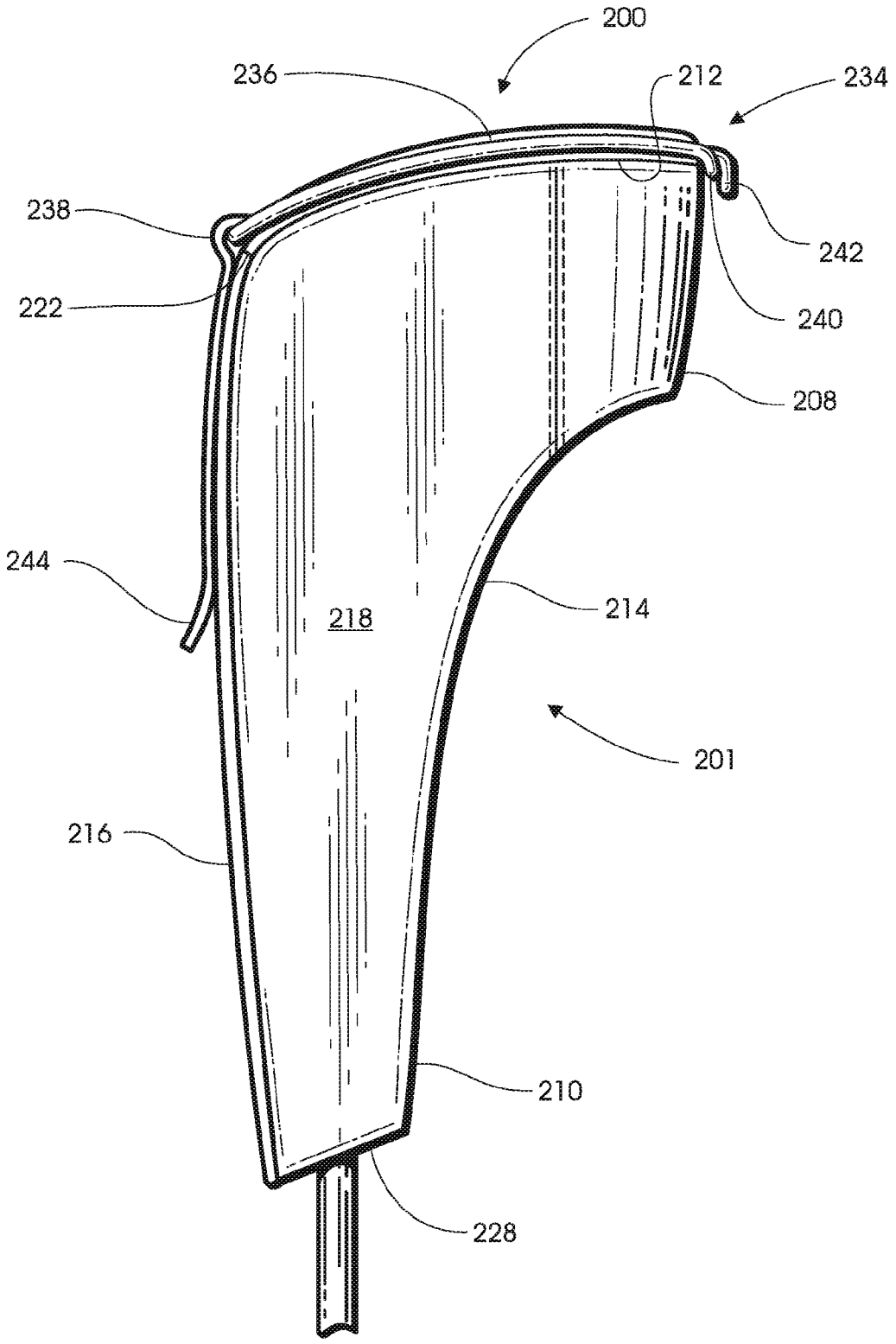
FIG. 15 is a side view of the top loading headcover of FIG. 12.
Figure 16:
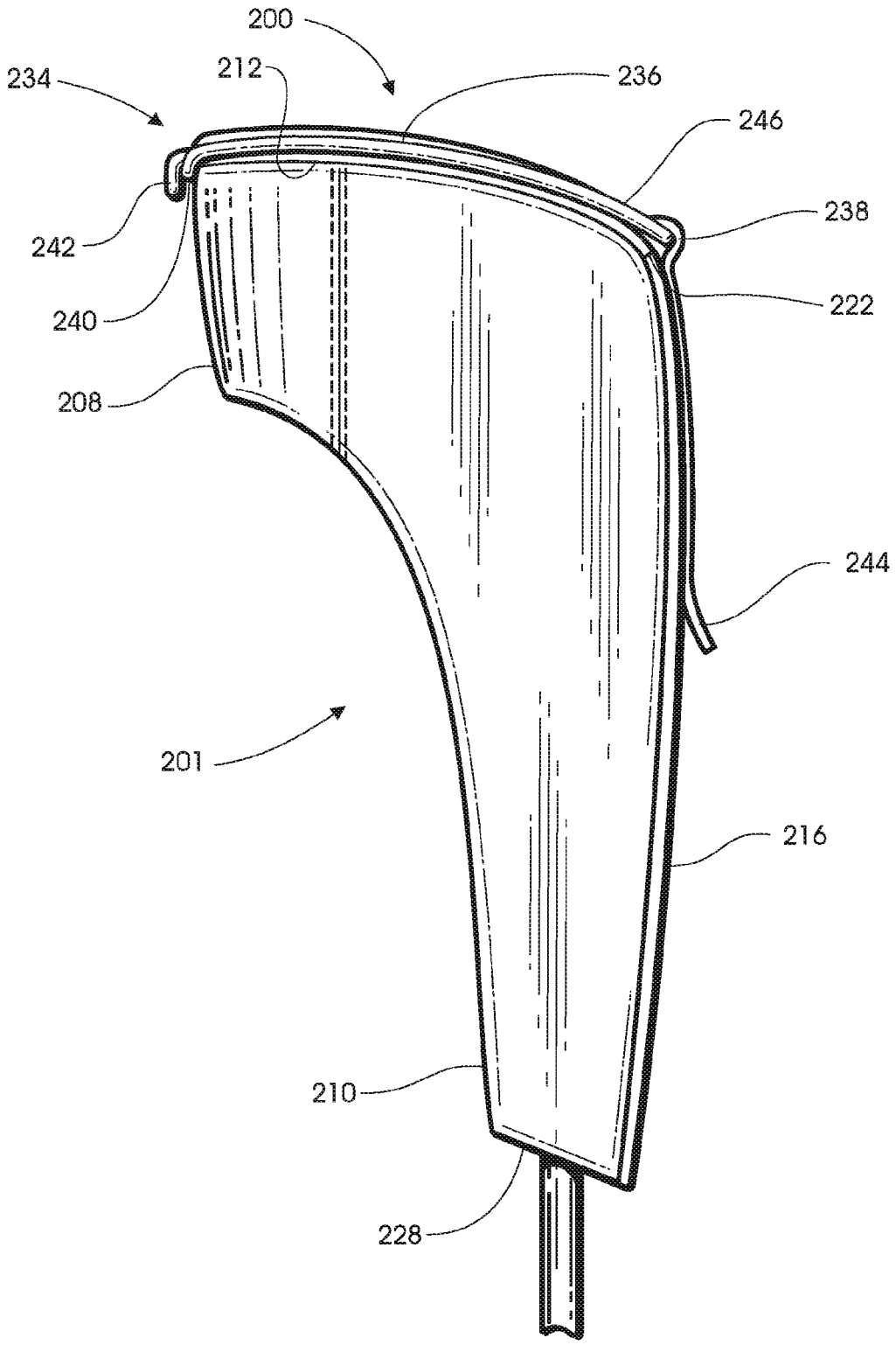
FIG. 16 is an opposite side view of the top loading headcover of FIG. 12.

The biasing mechanism 234 further includes an elastic member 240 forming a loop configuration that is configured to engage the webbing strip 236 to maintain the top shroud 212 in either the closed or open positions. In particular, as shown in FIG. 12, the elastic member 240 is configured to have one portion engaged to the distal hook portion 242 at a first anchor point 246 while another portion of the elastic member 240 is configured to engage the webbing strip 236 along channel 238 at a second anchor point 248 to maintain the top shroud 212 in the closed position. As shown in FIG. 17, the elastic member 240 is also configured to have one portion engaged to the proximal hook portion 244 at a third anchor point 250 while another portion of the elastic member 240 is configured to engage the webbing strip 236 along channel 238 at a fourth anchor point 252. Due to the elasticity of the elastic member 240, the elastic member 240 imparts a spring force that firmly secures the top shroud 212 to the distal opening 230 in the closed position (FIG. 12) or props open the top shroud 212 in the open position (FIG. 17). In operation, placing the top shroud 212 in the open position requires an individual to disengage the elastic member 240 from the distal hook portion 242 (FIG. 12) and engage the elastic member 240 to the proximal hook portion 244 (FIG. 17). This operation secures the top shroud 212 in the open position until the individual disengages the elastic member 240 from the webbing strip 236 and rotates the top shroud 212 back to the closed position. Conversely, placing the top shroud 212 in the closed position requires an individual to disengage the elastic member 240 from the proximal hook portion 244 of the webbing strip 236 and engage the elastic member 240 to the distal hook portion 242 of the webbing strip 236.

In one embodiment, the webbing strip 236 may be secured to the upper portion 208 of the headcover body 201 by a stitching arrangement, although in other embodiments the webbing strip 236 may be integral with the headcover body 201 or attached to the headcover body 201 using an adhesive or other like substance. In some embodiments, the elastic member 240 may be a bungee cord, although other types of elastic members, such as a rubber band, are contemplated that generate a bias when placed in a stretched condition. The apparatus, methods, and articles of manufacture are not limited in this regard.

As shown and described above in FIGS. 7-10 in relation to headcover 100, the headcover 200 may also be used to retrieve and store the golf club 202 in a substantially similar manner as headcover 100. In particular, the headcover 200 may be placed on the floor or ground while an individual is using the golf club 202 and then the individual may retrieve and store the golf club 202 by inserting the proximal end 226 of the club shaft 204 (e.g., the end of the club shaft 204 having the grip 232) through the distal opening 230 and into the interior portion 254 of the headcover 200. Once the individual inserts the golf club 202 through the distal opening 230, the club shaft 204 may be oriented in a substantially upward manner relative to the ground such that the headcover 200 slides downward along the club shaft 204 by force of gravity until the headcover 200 reaches the distal end 224 of the club shaft 204 proximate the club head 206. Once the club head 206 reaches the distal end 224 of the club shaft 204 the club head 206 may be passed through the distal opening 230 and disposed within the interior portion 254 of the headcover 200. Once the club head 206 is fully disposed within the headcover 200, the individual places the top shroud 212 in the closed position and engages the elastic member 240 to the distal hook portion 242 to maintain the top shroud 212 in the closed position. During this operation, the elastic member 240 remains engaged to the channel 238 of the webbing strip 236.

Figure 18:
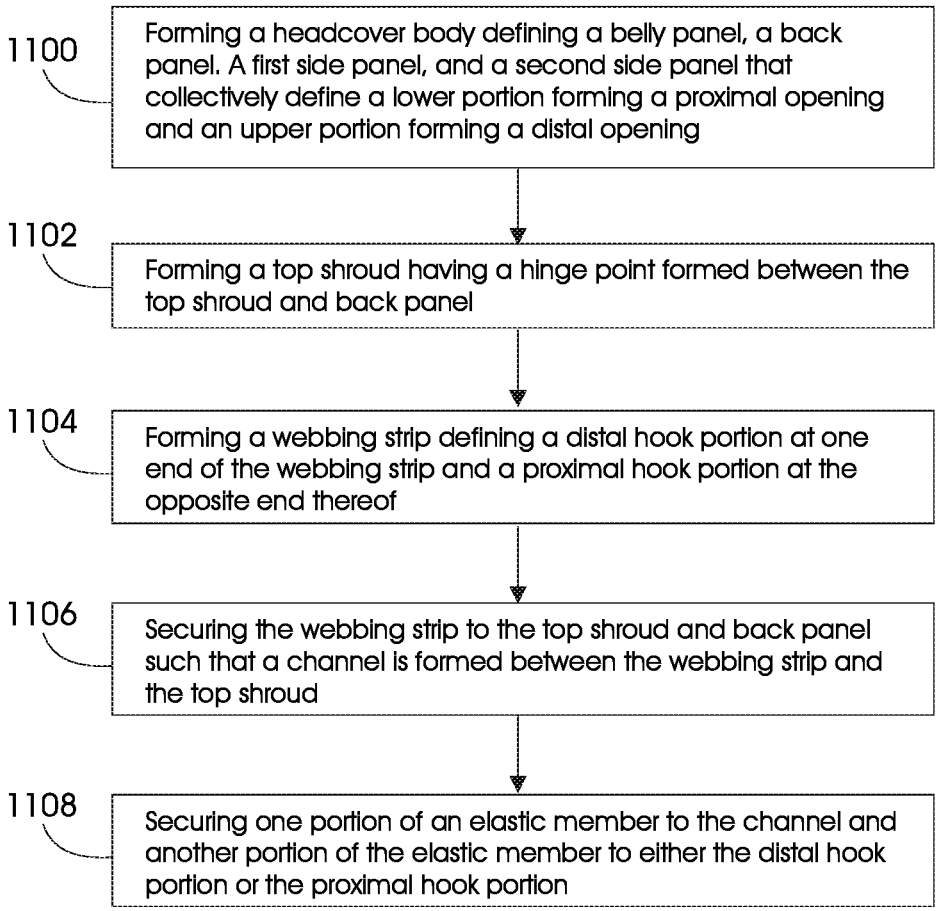
FIG. 18 is a flow chart illustrating a method for manufacturing the top loading headcover of FIG. 12.

Referring to FIG. 18, one method for manufacturing the headcover 200 is illustrated. At block 1100, forming a headcover body 201 defining a belly panel 214, a back panel 216, a first side panel 218 and a second side panel 220 that collectively define a lower portion 210 forming a proximal opening 228 and an upper portion 208 forming a distal opening 230. At block 1102, forming a top shroud 212 having a hinge point 222 formed between the top shroud 212 and the back panel 216. At block 1104, forming a webbing strip 236 defining a distal hook portion 242 at one end of the webbing strip 236 and a proximal hook portion 244 at the opposite end thereof. At block 1106, securing the webbing strip 236 to the top shroud 212 and back panel 216 such that a channel 238 is formed between the webbing strip 236 and the top shroud 212. At block 1108, securing one portion of an elastic member 240 to the channel 238 and another portion of the elastic member 240 to either the distal hook portion 242 or the proximal hook portion 244.

While a particular order of actions is illustrated in FIG. 18, these actions may be performed in other temporal sequences. For example, two or more actions depicted in FIG. 18 may be performed sequentially, concurrently, or simultaneously. Alternatively, two or more actions depicted may be performed in reverse order. Further one or more actions in FIG. 18 may not be performed at all. The apparatus, methods, and articles of manufacture described herein are not limited in this regard.

Figures 20, 21:
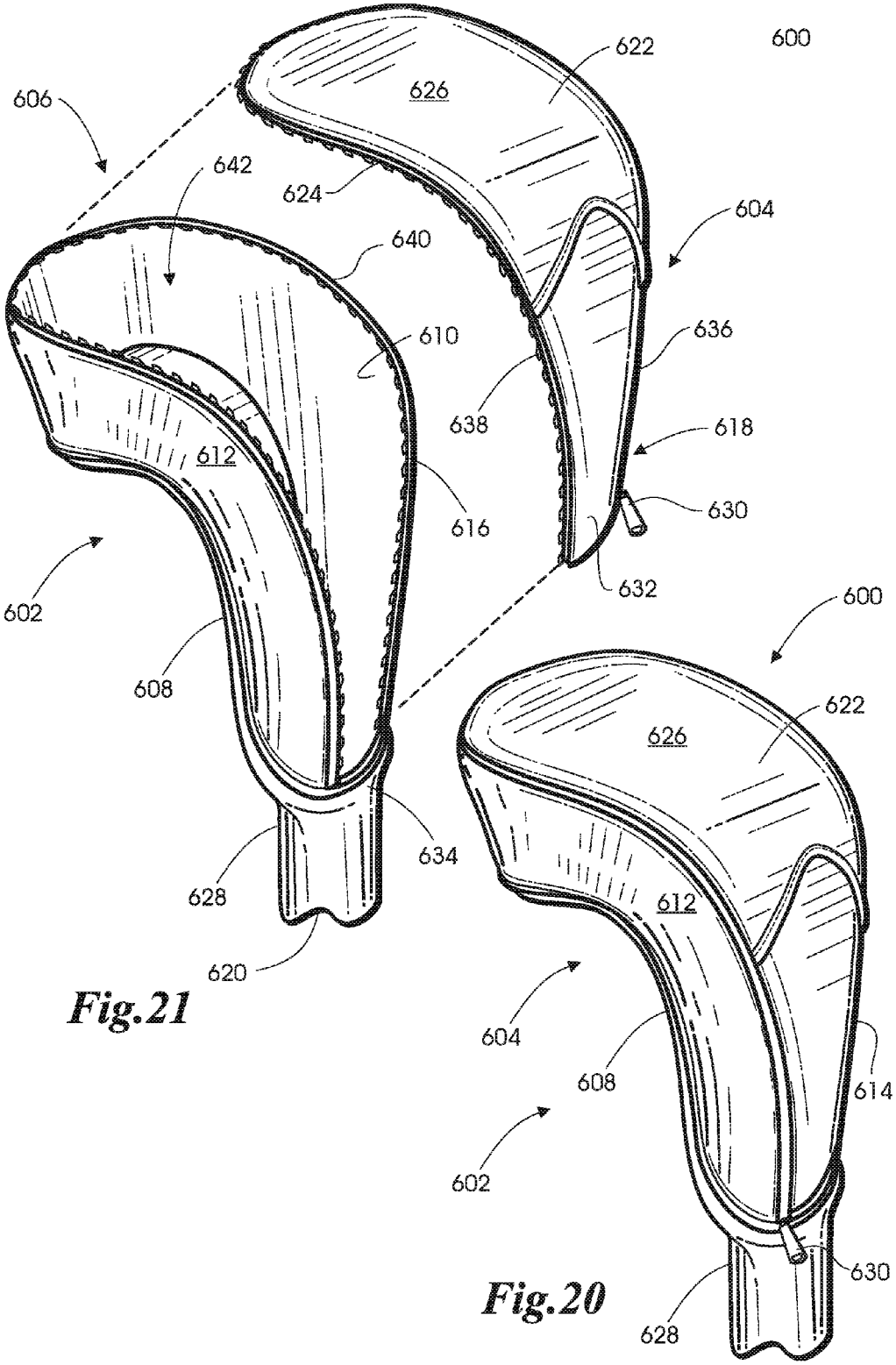
FIG. 20 is a perspective view of another embodiment of a headcover.
FIG. 21 is an exploded view of the headcover of FIG. 20 showing the top piece detached from the universal bottom piece.

Referring to FIGS. 20 and 21, an embodiment of a bottom loading headcover, designated 600, may include a headcover body 602 having a detachable top piece 604 engaged to a universal bottom piece 606. In some embodiments, the universal bottom piece 606 may be defined by a belly panel 608, a first side panel 612, and a second side panel 614. As shown, the first side panel 612 and the second side panel 614 collectively define a peripheral edge 616 that forms a top opening 610 that is configured to be covered by the detachable top piece 604. The top opening 610 communicates with an interior portion 642 configured to receive a golf club (not shown) therein. As further shown, the universal bottom piece 606 may include a sleeve 628 that forms a bottom opening 620 configured to allow a golf club to be inserted through such that the head of the golf club may be disposed within the interior portion 642. In addition, the universal bottom piece 606 may further include a recess 634 formed adjacent the top opening 610 proximate the sleeve 628. In some embodiments, the recess 634 may be offset a predetermined distance below the plane defined by the peripheral edge 616.

In some embodiments, the detachable top piece 604 may be defined by an inner surface 624 that communicates with the interior portion 642 of the universal bottom piece 606 and an outer surface 626 having a pull strap 622 attached thereto. The pull strap 622 is configured to be grasped by an individual when pulling the headcover body 602 on or off the golf club. In some embodiments, the pull strap 622 may have a three-legged configuration, although in other embodiments the pull strap 622 may have a two-legged configuration.

In addition, the detachable top piece 604 defines a peripheral edge 636 can include a zipper arrangement 618 that allows the detachable top piece 604 to be engaged and disengaged from the universal bottom portion 606. In particular, the zipper arrangement 618 may be a conventional zipper arrangement that includes a first set of teeth 638 extending along the peripheral edge 636 of the detachable top piece 604 and a second set of teeth 640 extending along the peripheral edge 616 of the universal bottom piece 606. The first and second set of teeth 638 and 640 are configured to engage or disengage each other based on the direction that a pull tab 630 is pulled by the individual. In other embodiments, the detachable top piece 604 can be engaged and disengaged from the universal bottom piece 606 using a hook and loop arrangement, a latch arrangement, a hook arrangement, and a magnet-type arrangement. The apparatus, methods, and articles of manufacture described herein are not limited in this regard.

Referring to FIG. 21, in some embodiments the detachable top piece 604 may further include a bottom portion 632 configured to contact the recess 634 of the universal bottom piece 606 when the detachable top piece 604 is engaged to the universal bottom piece 606. In some embodiments, the bottom portion 632 may be formed to extend beyond the recess 634 when the detachable top piece 604 is engaged to the universal bottom piece 606 at recess 634. In some embodiments, the zipper arrangement 618 extends along the respective peripheral edges 616 and 636 with the exception of the bottom portion 632 for the detachable top piece 604 and the corresponding peripheral edge 616 for the universal bottom piece 606 (i.e., the recess 634). In other embodiments, the bottom portion 632 may be fastened or otherwise secured to the recess 634, for example a one-piece fastener or a two-piece fastener (not shown) that allows the bottom portion 632 of the detachable top piece 604 to fasten or be attached to the bottom portion 632 when the detachable top piece 604 is engaged to the universal bottom piece 606. In other embodiments, a loop and hook arrangement (not shown), such as VELCRO®, may be used to also secure the bottom portion 632 to the universal bottom piece 606. Yet, in other embodiments the zipper arrangement 618 may extend along the entirety of both peripheral edges 616 and 636. The apparatus, methods, and articles of manufacture described herein are not limited in this regard.

In one aspect, a plurality of universal bottom pieces 606 with the top openings 610 exposed may each receive a respective universal bottom piece 606 with each respective interior portion 642 in a stacking configuration, thereby making storage and transportation easier. In some embodiments, the first and second side panels 612 and 614 may form seams or pleats that allow the universal bottom piece 606 to be collapsed to allow for easier stacking. Similarly, the disengaged detachable top pieces 604 may also be stacked together for storage and transportation.

In addition, the detachability of the detachable top piece 604 also allows different types of detachable top pieces 604 to be used with the same universal bottom piece 604. For example, the detachable top pieces 604 may have differently configured pull straps 622 and/or product logos (not shown) that may be interchanged with the universal bottom piece 606. The apparatus, methods, and articles of manufacture described herein are not limited in this regard.

Figure 22:
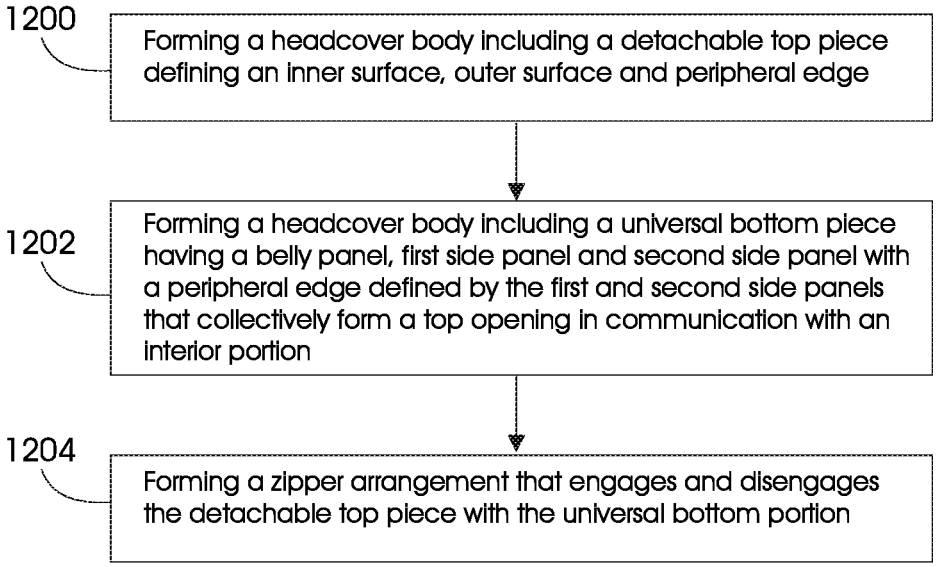
FIG. 22 is a flow chart illustrating one method for manufacturing the headcover of FIG. 20.

Referring to FIG. 22, one method for manufacturing the headcover 600 is illustrated. At block 1200, forming a headcover body 602 including a detachable top piece 604 defining an inner surface 624, an outer surface 626, and a peripheral edge 616. At block 1202, forming a headcover body 602 including a universal bottom piece 606 having a first side panel 612 and a second side panel 614 with a peripheral edge 616 defined by the first and second side panels 612 and 614 that collectively form a top opening 610 in communication with an interior portion 642. At block 1206, forming a zipper arrangement 618 that engages and disengages the detachable piece 604 with the universal bottom piece 606.

While a particular order of actions is illustrated in FIG. 22, these actions may be performed in other temporal sequences. For example, two or more actions depicted in FIG. 22 may be performed sequentially, concurrently, or simultaneously. Alternatively, two or more actions depicted may be performed in reverse order. Further one or more actions in FIG. 22 may not be performed at all. The apparatus, methods, and articles of manufacture described herein are not limited in this regard.

Referring to FIGS. 23-30, one embodiment of a headcover, designated 700, includes a first embodiment of a detachable pull strap 714 that may be engaged or disengaged from a headcover body 702, thereby allowing different types of pull straps 714, 814, 914, 1014, and 1114 to be used with the headcover body 702 as shall be described in greater detail below.

Figure 23:
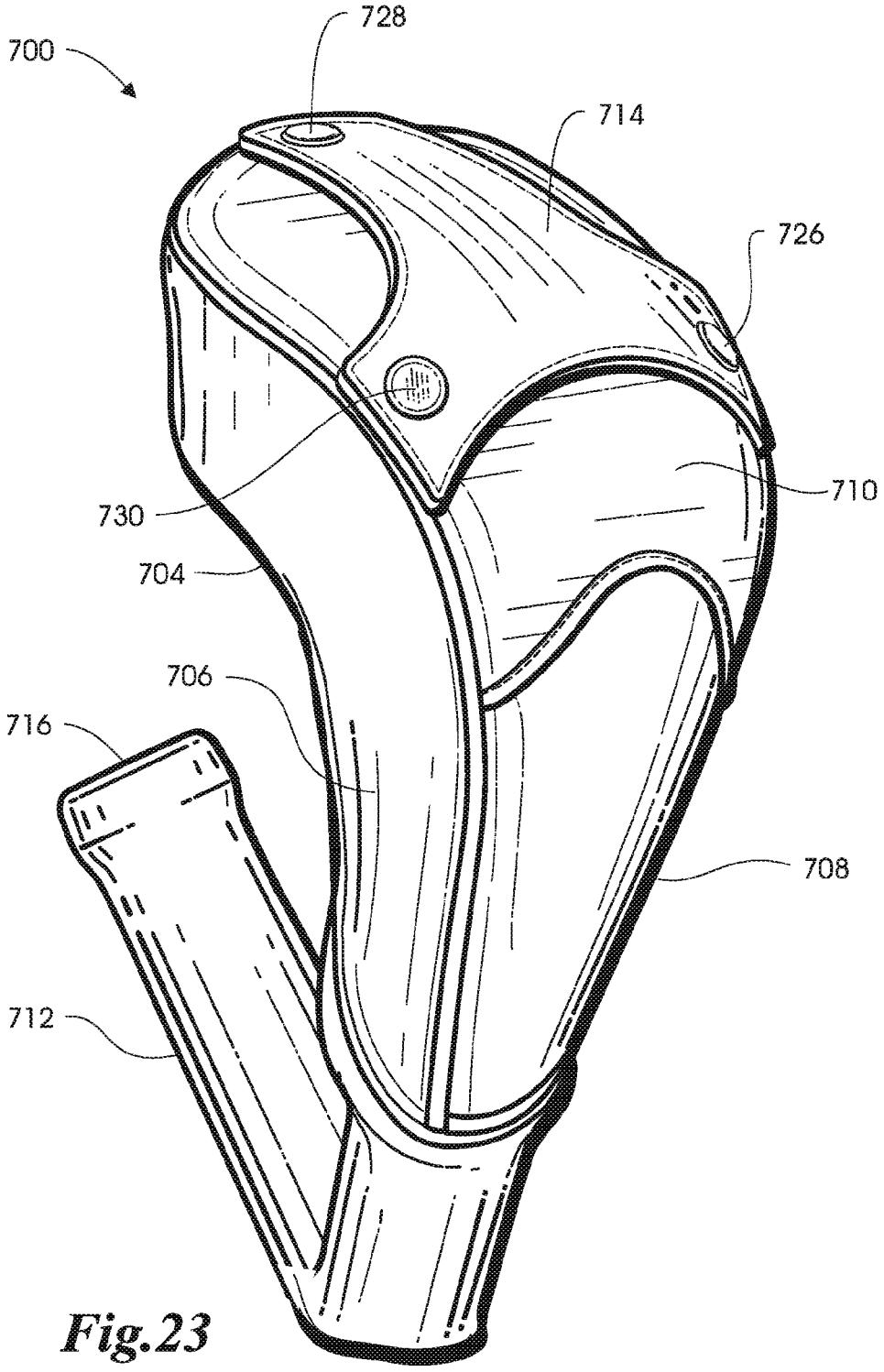
FIG. 23 is a perspective view of an embodiment of a headcover with a detachable pull strap having a snap attachment.
Figure 24:
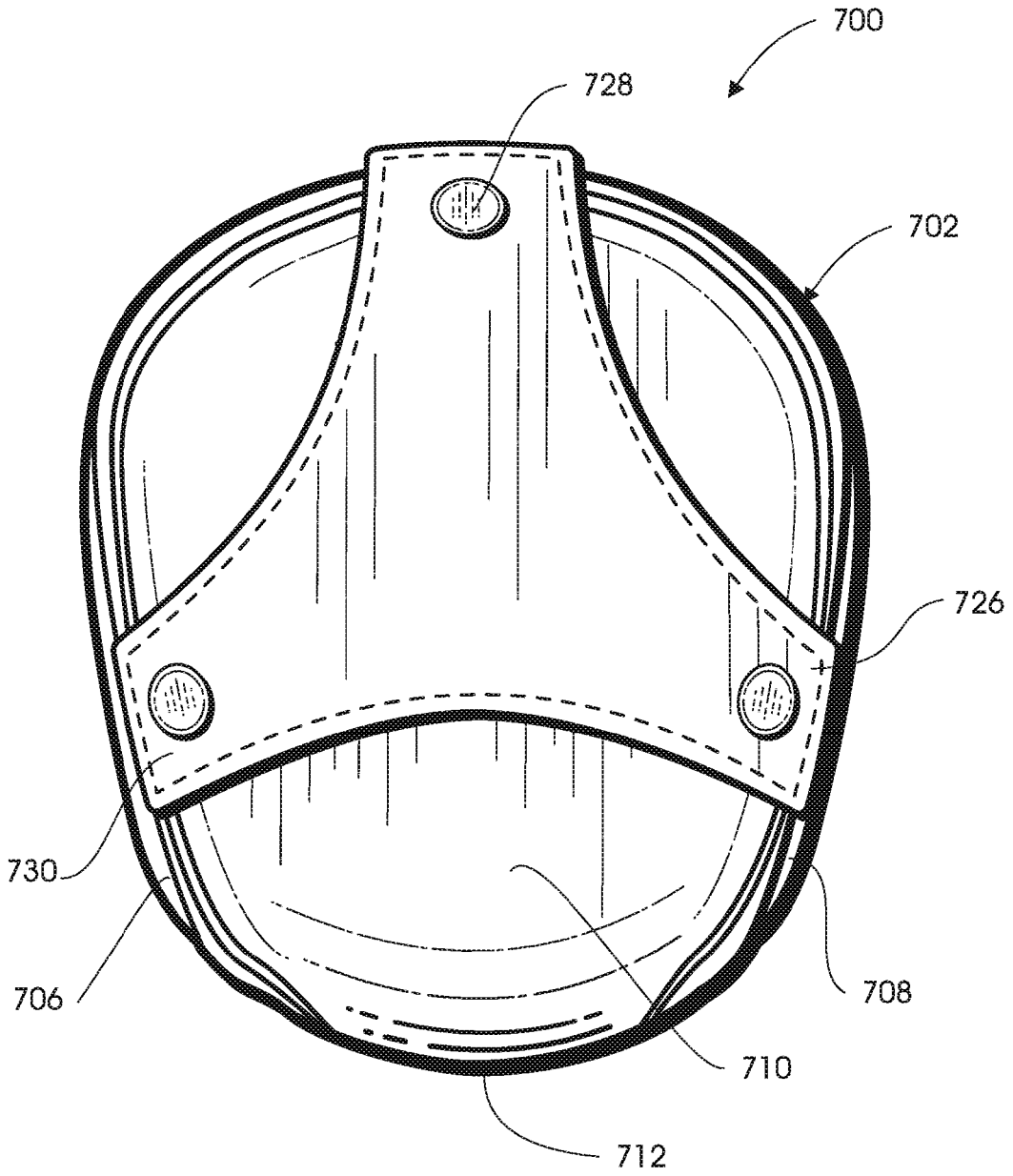
FIG. 24 is a top view of the headcover of FIG. 23 with the detachable pull strap secured to the headcover.
Figure 25:
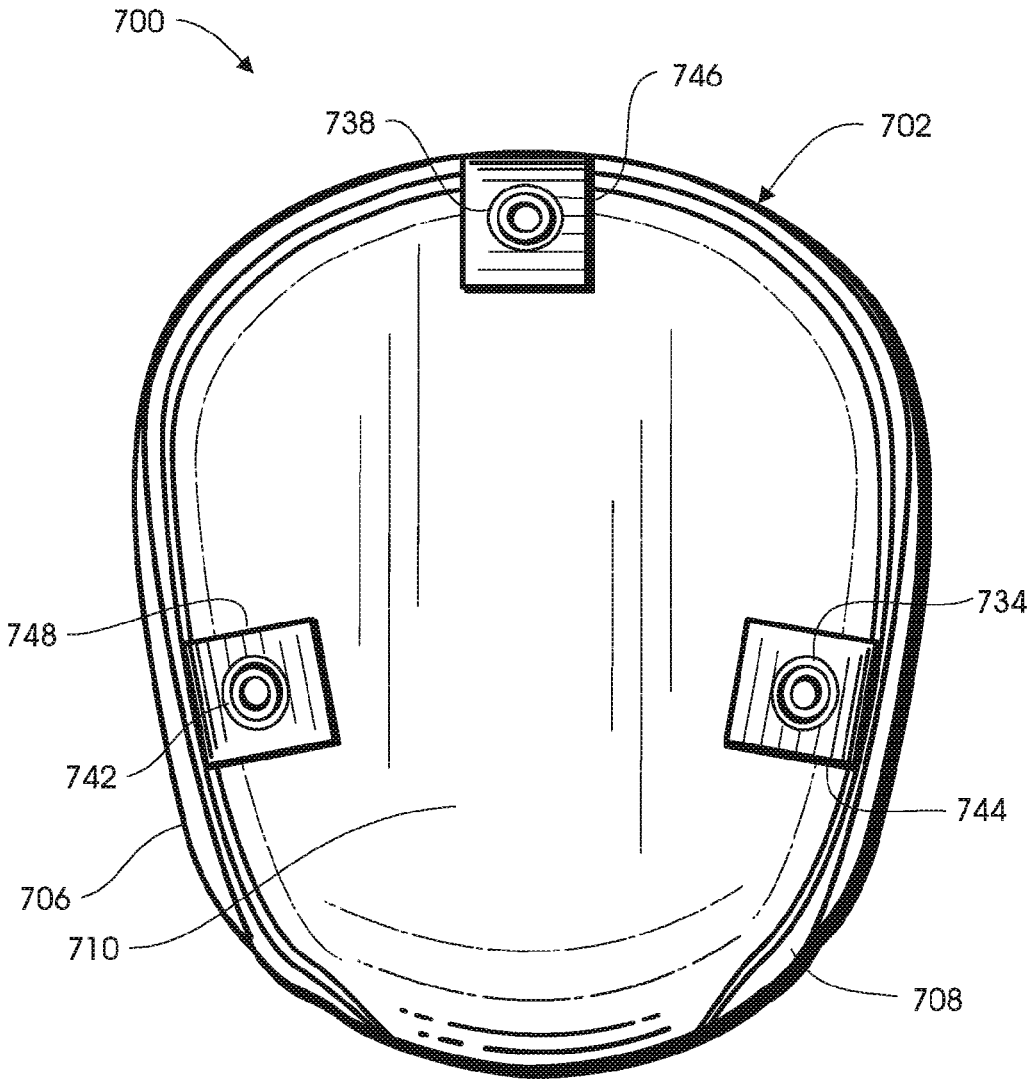
FIG. 25 is a top view of the universal headcover of FIG. 23 with the detachable pull strap removed from the headcover.

As shown in FIGS. 23-25, the headcover body 702 includes a belly panel 704, a first side panel 706, a second side panel 708 and top panel 710 that collectively define an interior portion (not shown) configured to receive a club head (not shown) of a golf club therein. In one embodiment, the detachable pull strap 714 has a pull strap body 718 defining a first leg portion 720, a second leg portion 722 and a third leg portion 724. In other embodiments, the pull strap body 718 may have any of a plurality of leg portions configured to engage the headcover body 702.

As shown in FIGS. 23 and 24, in some embodiments the headcover 700 includes a first snap fastener 726, a second snap fastener 728, and a third snap fastener 730 to detach or attach the first, second, and third leg portions 720, 722 and 724 of the detachable pull strap 714 from or to the headcover body 702. As noted above, this arrangement allows different pull straps 714 to be attached to the headcover body 702, thereby allowing different pull straps 714 to be used with the same universal-type headcover body 702

Figure 26:
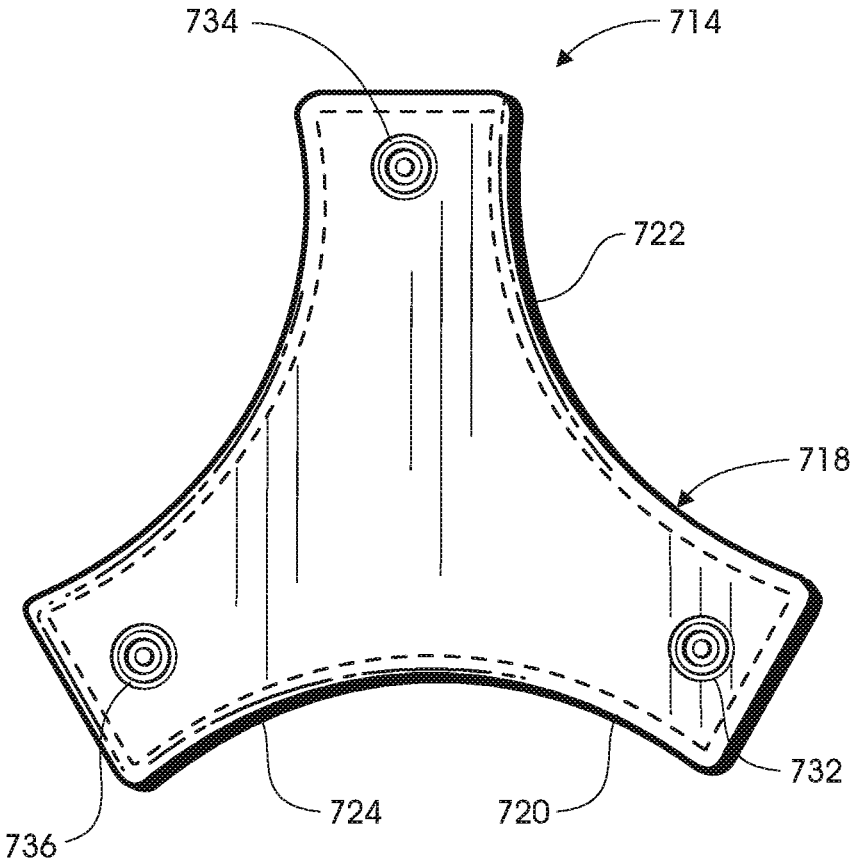
FIG. 26 is a front view of the detachable pull strap shown in FIG. 23.

Referring to FIGS. 25 and 26, the first snap fastener 726 includes a first attaching unit 732 disposed on the pull strap 714 and is configured to be attached or detached from or to a first closure unit 734 disposed on a first tab 744 that extends from headcover body 702. Similarly, the second snap fastener 728 includes a second attaching unit 736 disposed on the pull strap 714 and is configured to be attached or detached from or to a second closure unit 738 disposed on a second tab 746 that extends from the headcover body 702. In addition, the third snap fastener 730 includes a third attaching unit 740 disposed on the pull strap 714 and is configured to be attached or detached from or to a third closure unit 742 disposed on a third tab 748 that extends from the headcover body 702. When engaging the pull strap 714 to the headcover body 702, each of the first, second and third fasteners 726, 728 and 730 are coupled together until the pull strap 714 is fully secured to the headcover body 702. Conversely, the first, second, and third fasteners 726, 728 and 730 may be decoupled to disengage the pull strap 714 from the headcover body 702.

In some embodiments, the first, second, and third attaching units 732, 736 and 740 may be a capped post or a capped ring. In some embodiments, the first, second and third closure units 734, 738 and 742 may be a socket or a stud. The apparatus, methods, and articles of manufacture described herein are not limited in this regard.

Figure 27:
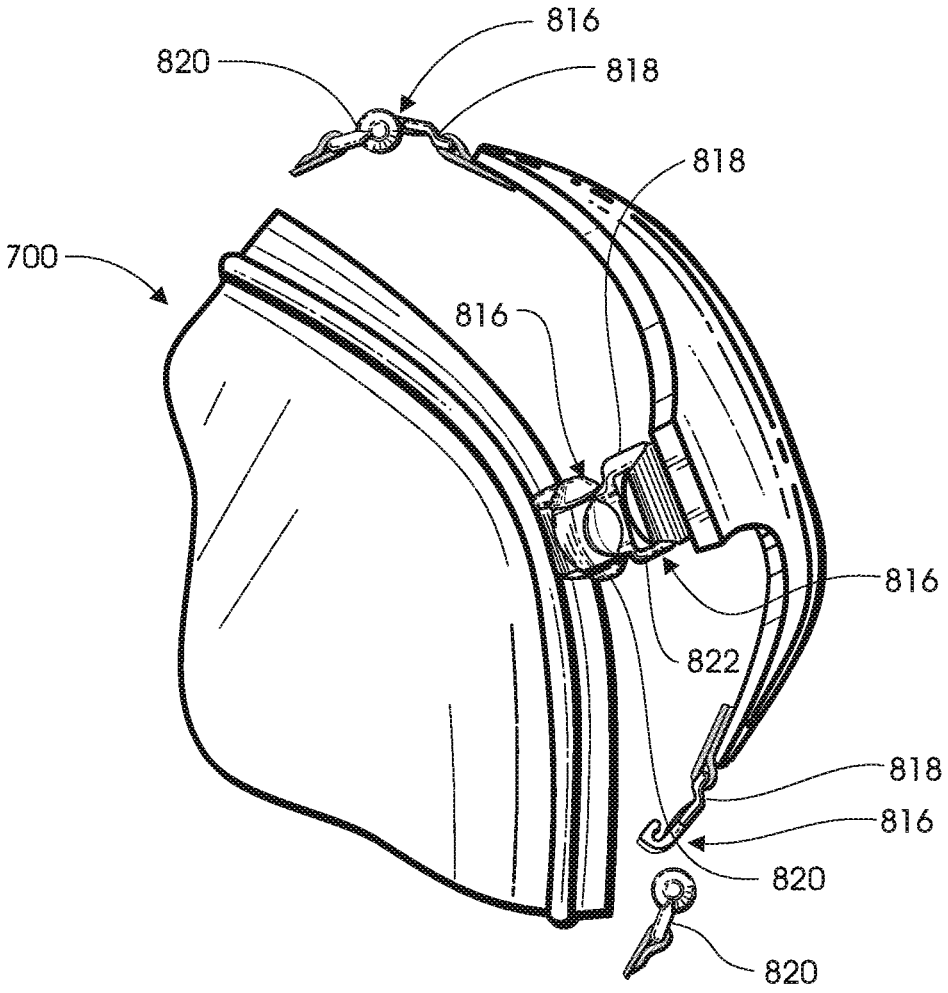
FIG. 27 is an enlarged perspective view of the headcover with another embodiment of a detachable pull strap with a clip attachment.

Referring to FIG. 27, a second embodiment of the pull strap, designated 814, includes a two-part clip fastener arrangement 816 for engaging and disengaging the pull strap 814 from the headcover body 702. In some embodiments, the two-part clip fastener arrangement 816 includes first, second and third fasteners 818 located along respective end portions of the pull strap 814 and respective portions of the headcover body 818. In particular, each of the first, second and third fasteners 818 includes a respective first fastener portion 820 extending from the pull strap 814 which is configured to engage or disengage from a respective second fastener portion 822 extending from the headcover body 702 proximately between the first side panel 706 and the top portion 710. This process is repeated for each of the first, second and third fasteners 818 until the pull strap 814 is fully secured to the headcover body 702. Conversely, the first, second and third fasteners 818 may be decoupled to disengage the pull strap 814 from the headcover body 702.

Figure 28:
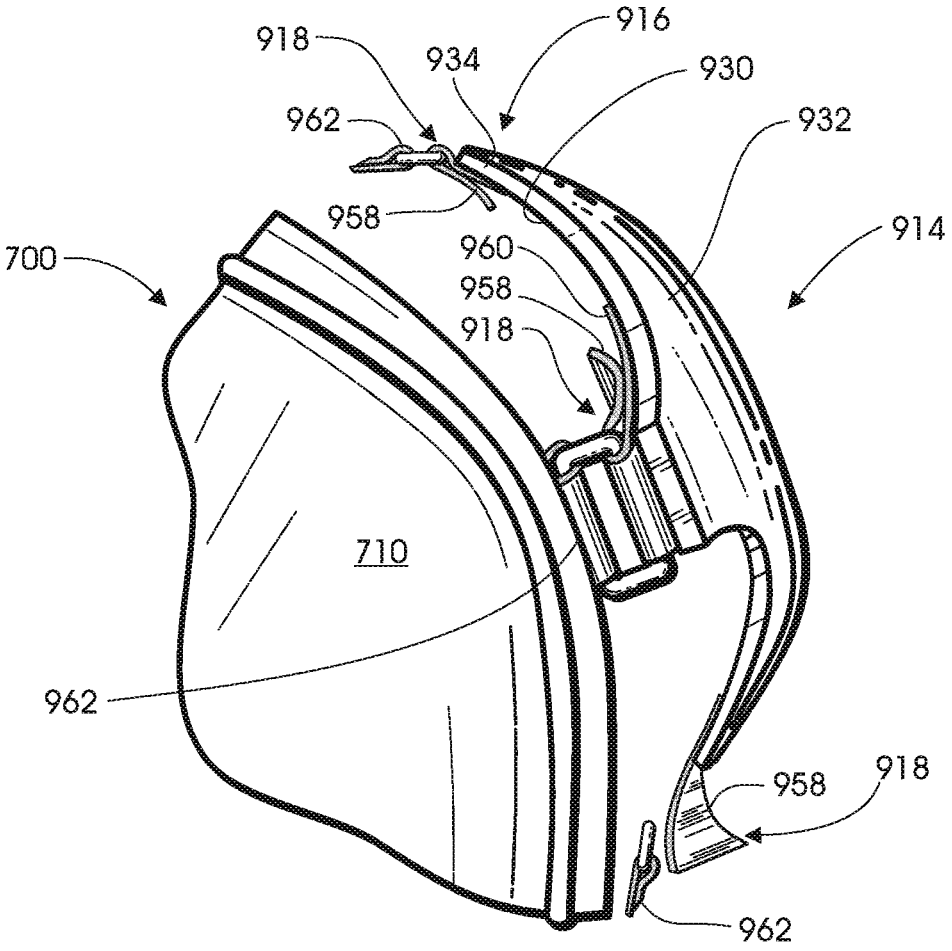
FIG. 28 is an enlarged perspective view of the headcover with another embodiment of a detachable pull strap with a doubled-up webbing attachment.

Referring to FIG. 28, a third embodiment of the pull strap, designated 914, defines an inner surface 930, an outer surface 932 and a peripheral edge 934. In addition, the pull strap 914 includes a hook and loop fastener arrangement 916 for engaging or disengaging the pull strap 914 to or from the headcover body 702. In some embodiments, the hook and loop arrangement 916 includes first, second and third hook and loop fasteners 918 located along respective end portions of the pull strap 914 and the headcover body 702. In particular, each of the first, second and third hook and loop fasteners 918 may be made from VELCRO®. In addition, each of the first, second and third hook and loop fasteners 918 may include a first hook and loop portion 960 located on the inner surface 930 of the pull strap 914 and a second hook and loop portion 958 that extends from the peripheral edge 934 of the pull strap 914. In addition, each hook and loop fastener 918 includes a clip 962 attached to the headcover body 702 in which the second hook and loop portion 958 is configured to pass through so that the first hook and loop portion 960 can be engaged to the second hook and loop arrangement 958 to secure the pull strap 914 to the headcover body 702. This process is repeated for each of the first, second and third hook and loop fasteners 918 until the pull strap 914 is fully secured to the headcover body 702. Conversely, the first, second and third hook and loop fasteners 918 may be disengaged to detach the pull strap 914 from the headcover body 702.

Figure 29:
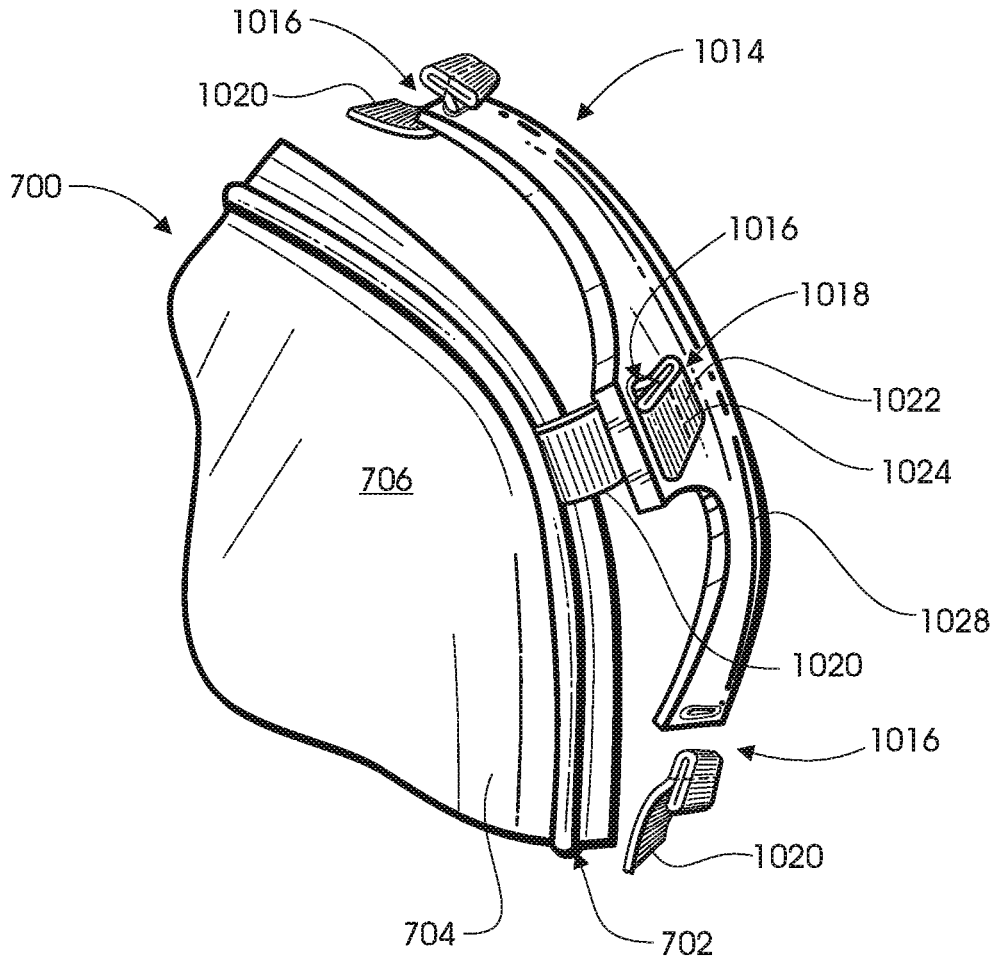
FIG. 29 is an enlarged perspective view of the headcover with another embodiment of a detachable pull strap with a hook and loop attachment.

Referring to FIG. 29, a fourth embodiment of the pull strap, designated 1014, includes a doubled-up webbing arrangement 1016 for engaging or disengaging the pull strap 1014 to or from the headcover body 702. In some embodiments, the doubled-up webbing arrangement 1016 may include first, second and third webbing extensions 1018 in which each respective webbing extension 1018 defines a secured end (not shown) that is attached to the headcover body 702 and an opposite doubled-up end 1022 having stitching 1024 that increases or doubles up the thickness of the webbing material relative to the secured end. The doubled up end 1022 is configured to pass through a respective slit 1020 formed through pull strap 1014 proximate the peripheral edge 1028. When attaching the pull strap 1014 to the headcover body 702, the doubled-up end 1022 is oriented in a particular orientation to lower the profile of the doubled-up end 1022 such that the doubled-up end 1022 can pass through slit 1020 of the pull strap 1014. Once the doubled-up end 1022 passes through the slit 1020, the doubled-up end 1022 may be oriented to an orientation that increases the profile of the doubled-up end 1022 and prevents passage of the doubled-up end 1022 back through the slit 1020, thereby establishing a secure attachment between the pull strap 1014 and the headcover body 702. This process is also repeated for each of the first, second and third webbing extensions 1018 until the pull strap 1014 is fully secured to the headcover body 702. Conversely, the first, second and third webbing extensions 1018 may be disengaged to detach the pull strap 1014 from the headcover body 702.

Figure 30:
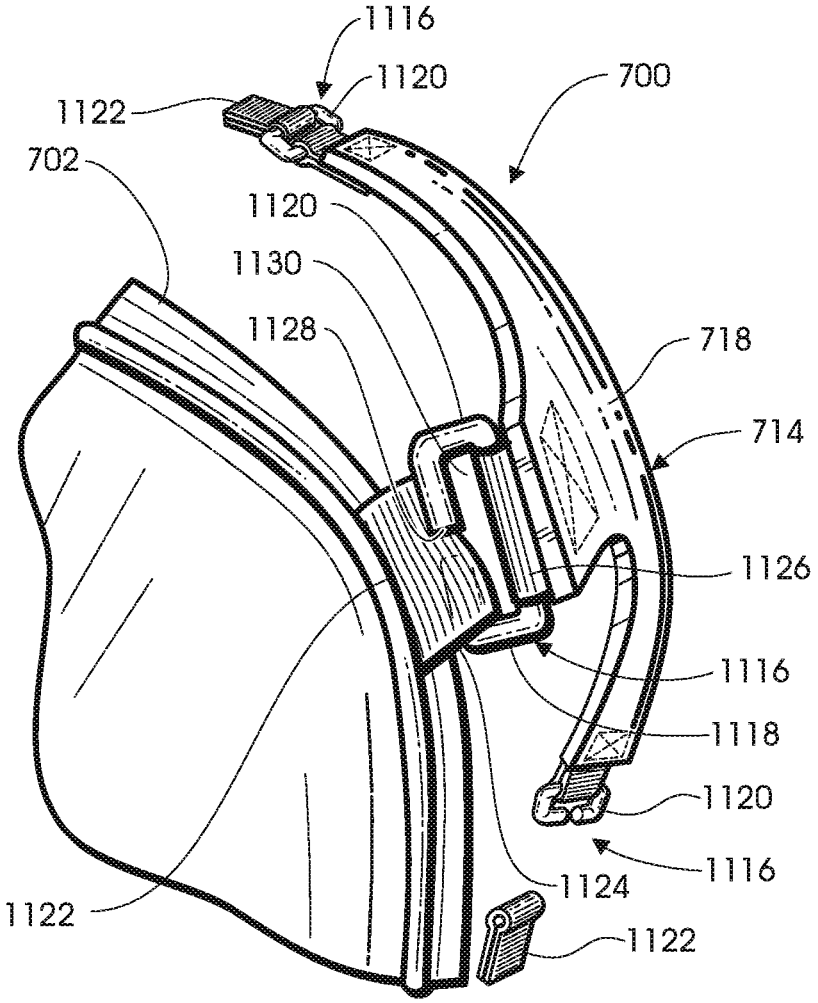
FIG. 30 is an enlarged perspective view of the headcover with another embodiment of a detachable pull strap with a loop arrangement.

Referring to FIG. 30, a fifth embodiment of the pull strap, designated 1114, includes a loop clip arrangement 1116 for engaging and disengaging the pull strap 1114 from the headcover body 702. In some embodiments, the loop clip arrangement 1116 includes first, second, and third loop clip fasteners 1118 in which each loop clip fastener 1118 includes a first strap extension 1126 engaged to a loop clip 1120 that is configured to be engaged to a second strap extension 1122 that extends from the headcover body 702. As shown, the loop clip 1120 forms an opening 1128 in communication with a slot 1130 defined by the loop clip 1120. When engaging each loop clip fastener 1118 together, a channel 1124 formed by the second strap extension 1122 is inserted through the opening 1128 of the loop clip 1120 until the second strap extension 1122 is disposed within the slot 1130, thereby securing the second strap extension 1122 to the first strap extension 1126. The process is repeated for each of the first, second and third loop clip fasteners 1118 until the pull strap 1114 is fully secured to the headcover body 702. Conversely, the first, second and third loop clip fasteners 1118 may be disengaged to detach the pull strap 1114 from the headcover body 702.

Figure 31:
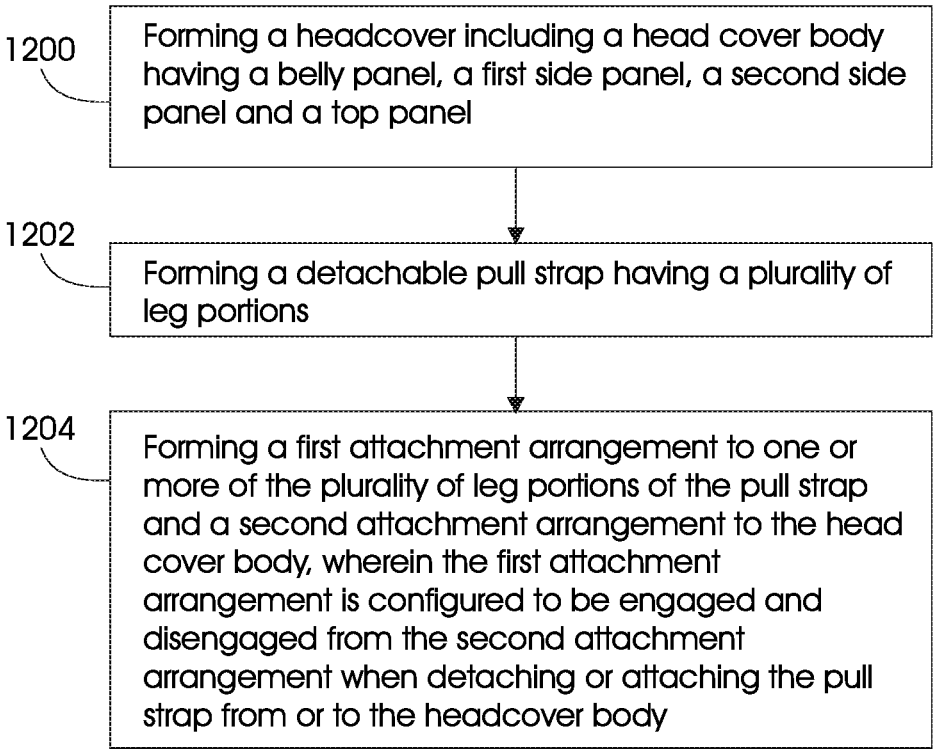
FIG. 31 is a flow chart illustrating one method for manufacturing the headcover with detachable pull strap.

Referring to FIG. 31, a flow chart illustrates one method for manufacturing the headcover 700. At block 1200, forming a headcover 700 including a headcover body 702 having a belly panel 704, a first side panel 706, a third side panel 708 and a top panel 710. At block 1202, forming a detachable pull strap 714 having a plurality of leg portions. At block 1204, forming a first attachment arrangement to one or more of the plurality of leg portions of the pull strap 714 and a second attachment arrangement to the headcover body 702, wherein the first attachment arrangement is configured to be engaged and disengaged from the second attachment arrangement when detaching or attaching the pull strap 714 from or to the headcover body 702.

While a particular order of actions is illustrated in FIG. 31, these actions may be performed in other temporal sequences. For example, two or more actions depicted in FIG. 31 may be performed sequentially, concurrently, or simultaneously. Alternatively, two or more actions depicted may be performed in reverse order. Further one or more actions in FIG. 31 may not be performed at all. The apparatus, methods, and articles of manufacture described herein are not limited in this regard.

Referring to FIGS. 32-37, one embodiment of a headcover, designated 1200, may include a headcover body 1202 having a plurality of collapsible portions 1212 configured to allow the headcover body 1202 to be configured between a non-collapsed configuration and a collapsed configuration. In the non-collapsed configuration, the headcover body 1202 is in a fully expanded form configured to receive a club head (not shown) therein, while in the collapsed configuration the headcover body 1202 is configured to have a reduced profile and smaller total volume than the headcover body 1202 in the non-collapsed configuration.

Figure 32:
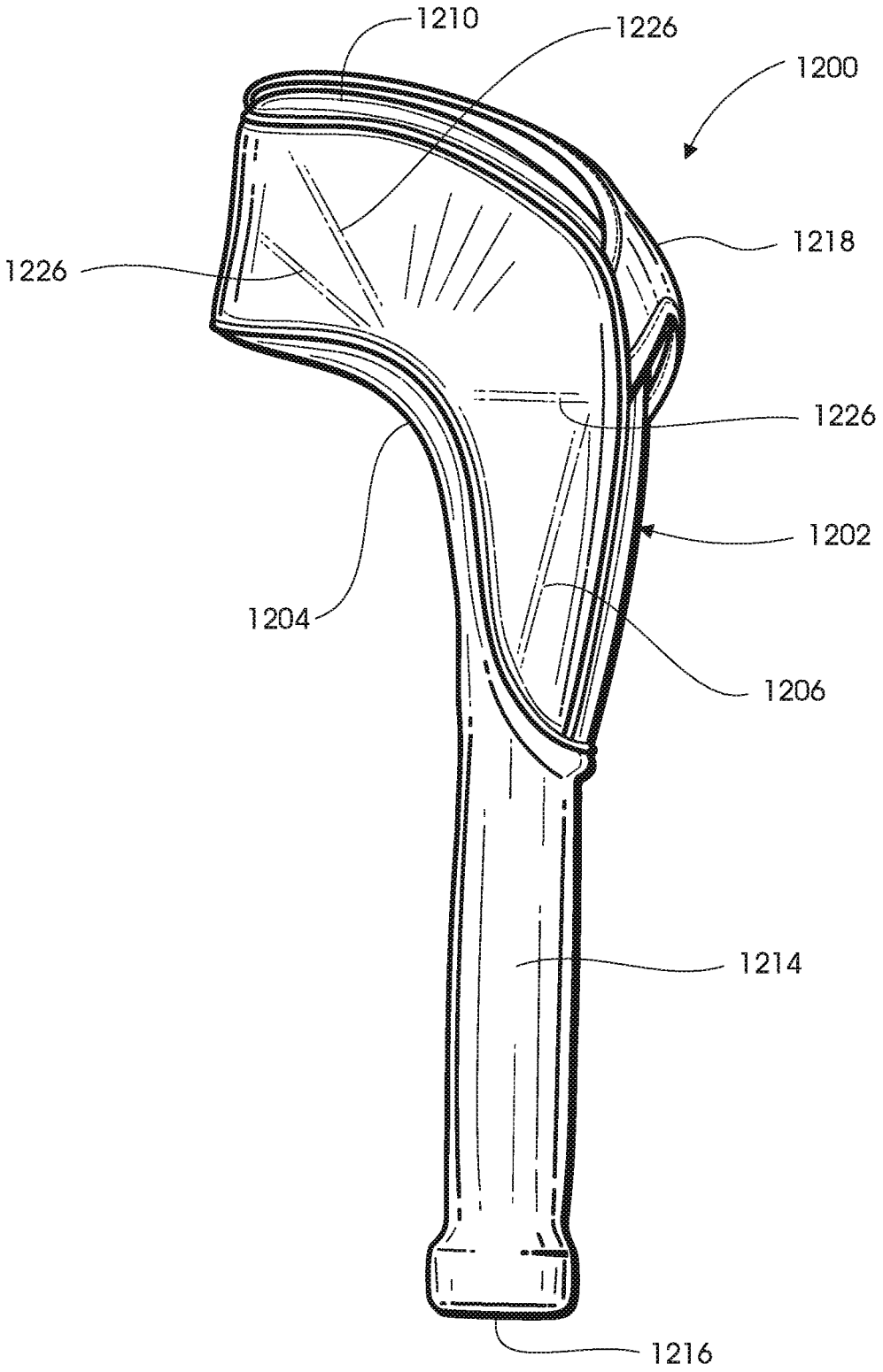
FIG. 32 is side view of an embodiment of a headcover with a collapsible configuration.

In some aspects, the collapsibility of the headcover 1200 prevents the headcover body 1202 from forming permanent creases that may occur if the headcover body 1202 has a fixed non-collapsible configuration and is stored for long periods of time in a confined storage area. As shown in FIG. 32, in some embodiments a temporary crease is formed, for example by each of the first, second, and third collapsible portions 1212, as the headcover body 1202 assumes the collapsed configuration. Conversely, when the headcover body 1202 assumes the non-collapsed configuration, the creases disappear from the headcover body 1202 as the plurality of collapsible portions 1212 allow the headcover body 1202 to expand outwardly.

In some embodiments, the plurality of collapsible portions 1212 may form creases, deformations, bends, and/or folds such that the headcover body 1202 is allowed to collapse to a smaller total volume than the volume of the headcover body 1202 in the non-collapsed configuration.

In some embodiments, the headcover body 1202 includes a belly panel 1204, a first side panel 1208, a second side panel 1208, and a top panel 1210 that collectively define an interior portion 1228 (shown in phantom in FIG. 32) configured to receive a club head therein when the headcover body 1202 is in the non-collapsed configuration. In some embodiments, the headcover body 1202 may include a sleeve 1214 that extends from the headcover body 1202 and defines an opening 1216 that permits passage of the club head into the interior portion 1228 of the headcover body 1202.

Figure 33:
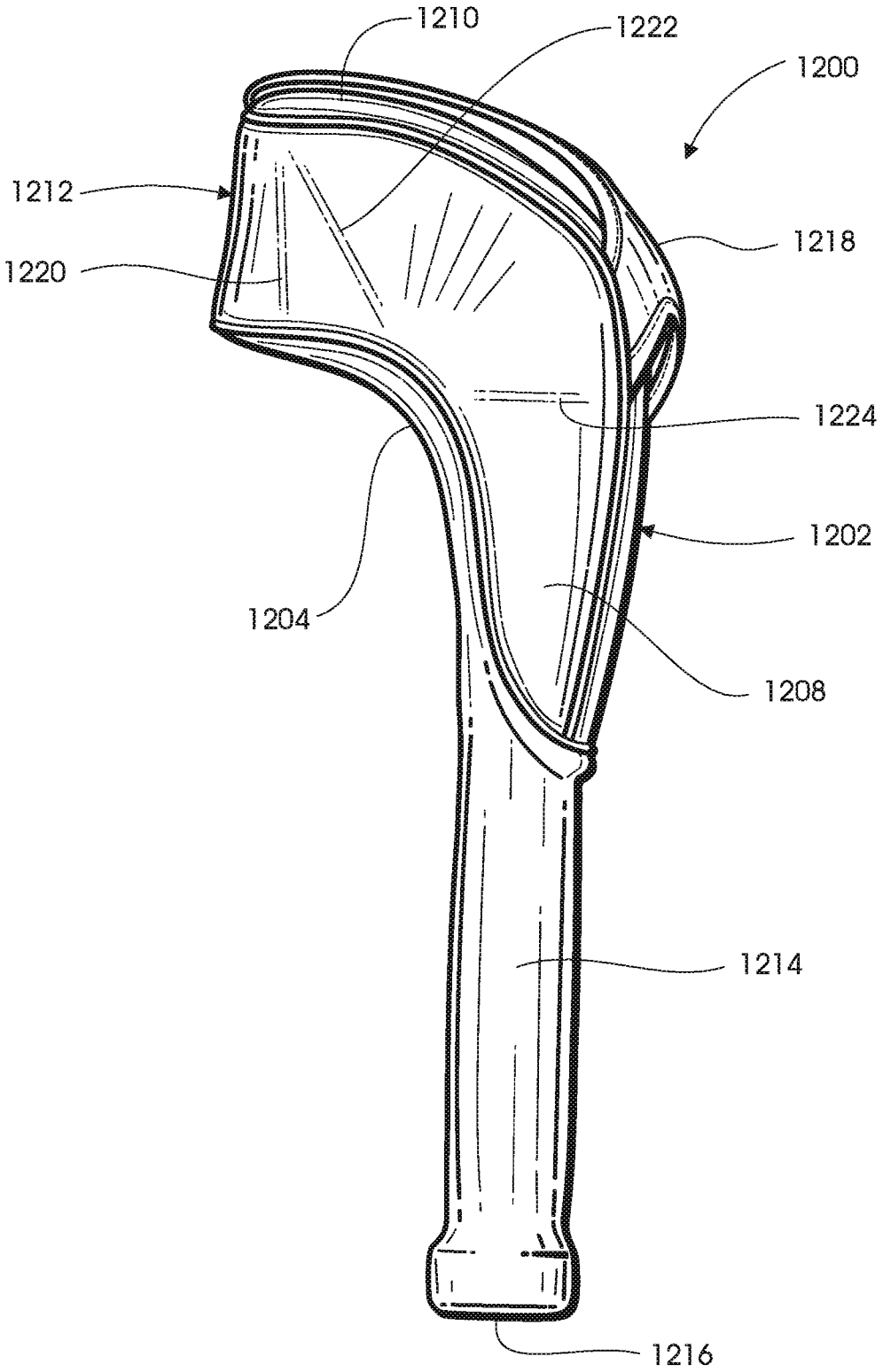
FIG. 33 is an opposite side view of the headcover of FIG. 32.
Figure 34:
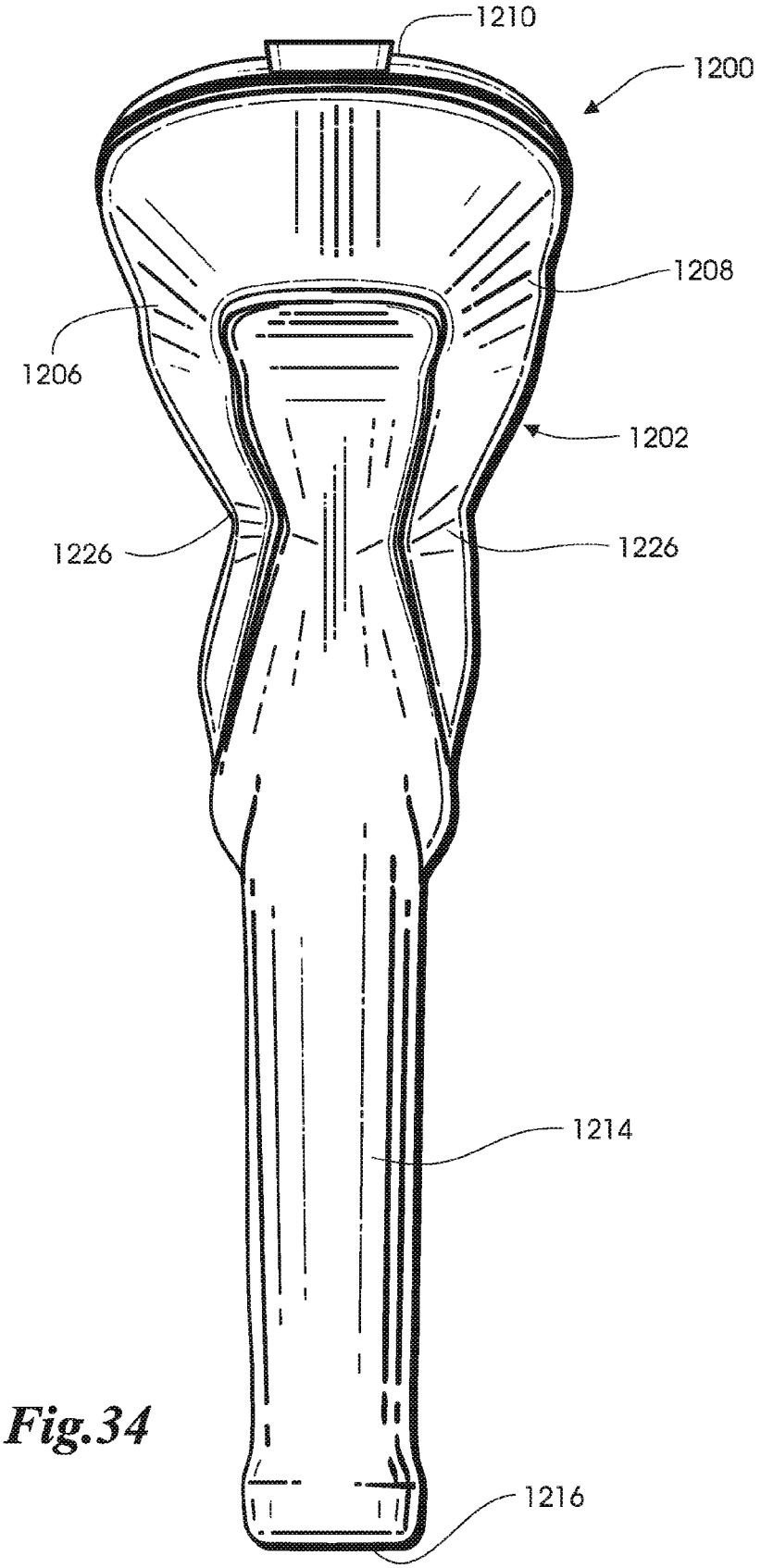
FIG. 34 is a front view of the headcover of FIG. 32.
Figure 35:
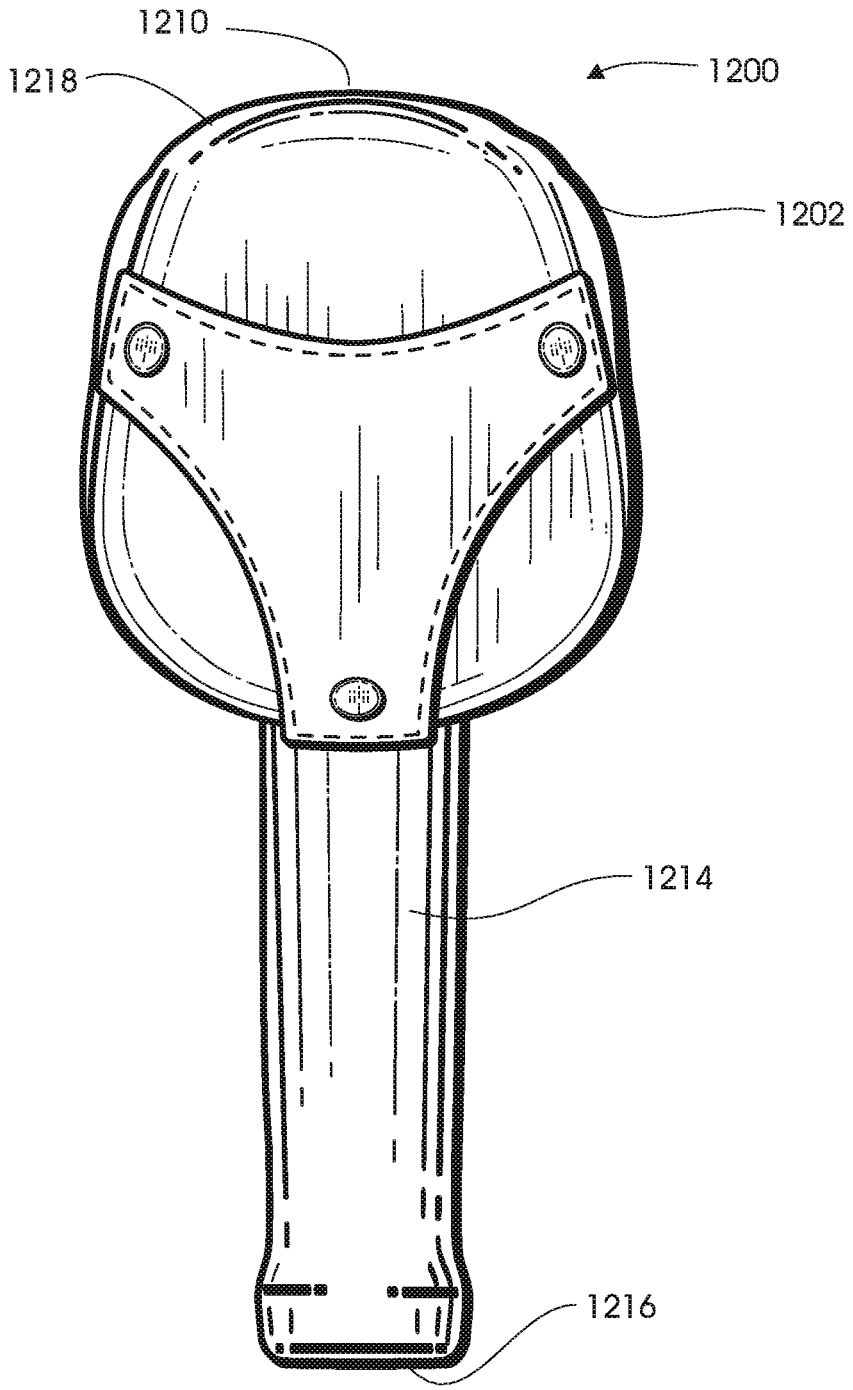
FIG. 35 is a rear view of the headcover of FIG. 32.
Figure 36:
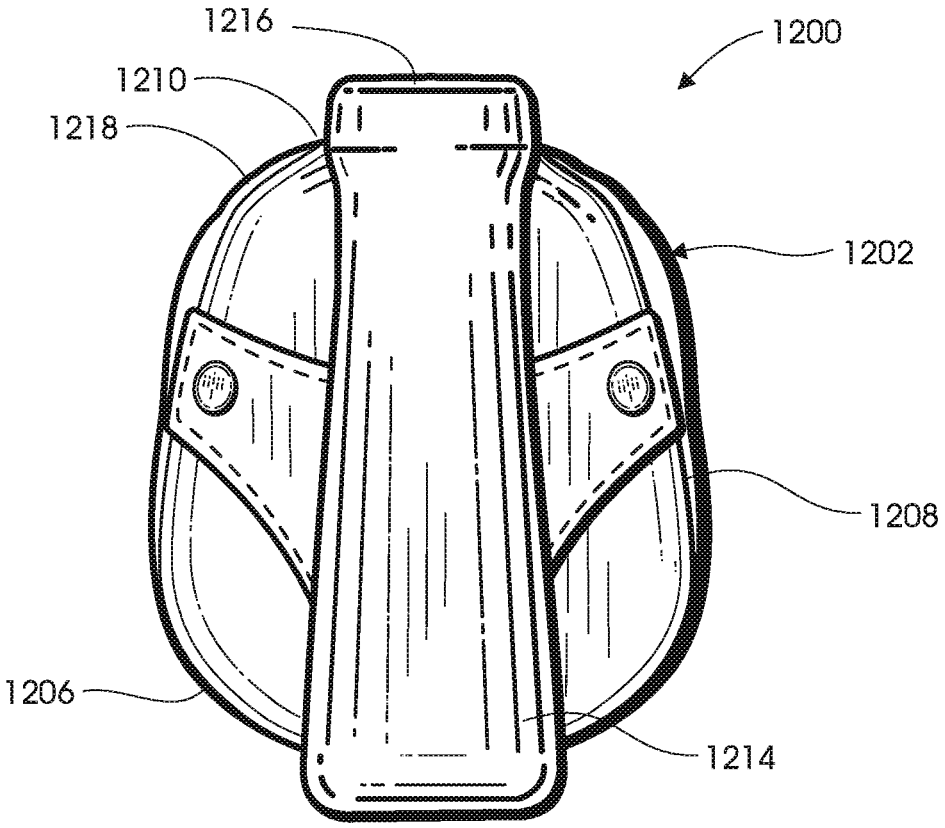
FIG. 36 is a bottom view of the headcover of FIG. 32.

As shown in FIG. 33, in some embodiments the plurality of collapsible portions 1212 may include first and second collapsible portions 1220 and 1222 that extend along both the first and second side portions 1206 and 1208 between the top panel 1210 and belly panel 1204 of the headcover body 1202. In some embodiments, the headcover body 1202 includes a third collapsible portion 1224 that extends at a substantially perpendicular angle relative to either the first or second collapsible portions 1220 and 1222. In other embodiments, the plurality of collapsible portions 1220 may extend along the seams defined between respective panels 1204, 1206, 1208 and 1210 or directly across one or more respective panels 1204, 1206, 1208 and 1210. The apparatus, methods, and articles of manufacture described herein are not limited in this regard.

In some embodiments, each of the plurality of collapsible portions 1212 may be a seam (not shown) formed between at least any two of the belly panel 1204, the first side panel 1206, the second side panel 1208, and the top panel 1210. The seams may be defined along the headcover body 1202 in a manner that allows the headcover 1200 to be configured between the non-collapsed configuration and the collapsed configuration.

In some embodiments, each of the plurality of collapsible portions 1212 may be an insert (not shown) of a collapsible material that allows the headcover body 1202 to be configured between the non-collapsed configuration and a collapsed configuration. The collapsible material may be made from a resilient or elastic material, such a plastic material, a fabric material, and/or a rubber material, that permits the headcover body 1202 to collapse inwardly.

In some embodiments, each of the plurality of collapsible portions 1212 may define a groove and/or depression (not shown) that allows the headcover body 1202 to be configured between the non-collapsed configuration and the collapsed configuration. In particular, the headcover body 1202 may include a foam-like filler material in which the grooves and/or depressions form one or more voids along the headcover body 1202 that lack any kind of material therein, thereby permitting the groove and/or depressions to fold portions of the headcover body 1202 inwardly to the collapsed configuration.

Although the embodiments of the headcover 1200 discussed above describe different types of collapsible portions 1212, such as seams, inserts, depressions, grooves and stitched lines, the headcover body 1202 may include any one or more of these types of collapsible portions 1212 in one headcover body 1202.

Figure 37:
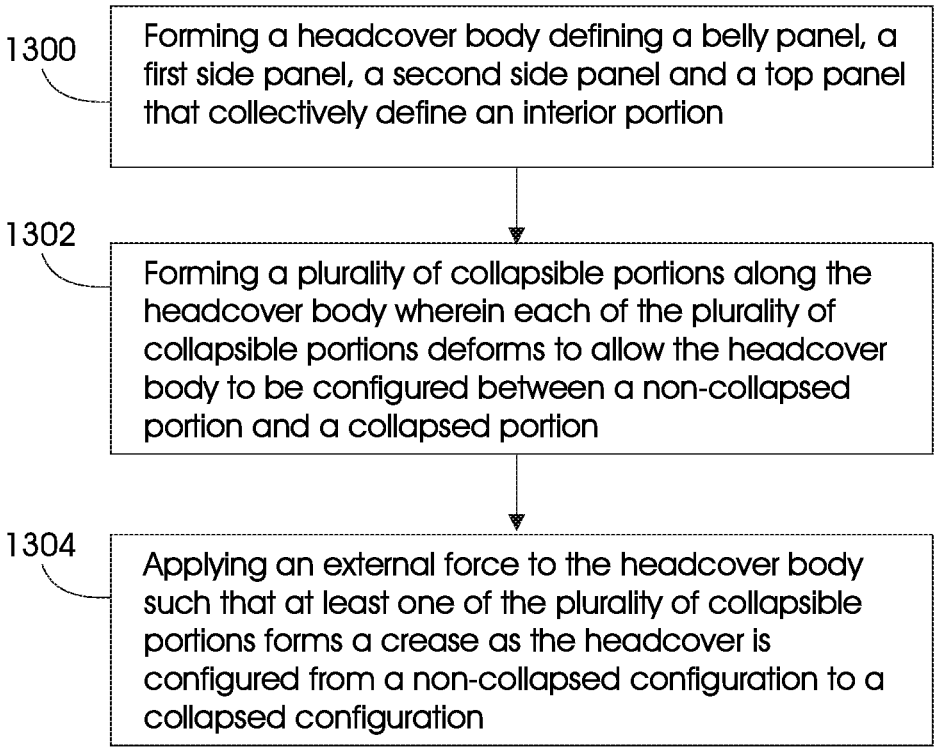
FIG. 37 is a flow chart illustrating one method for manufacturing the headcover of FIG. 32.

Referring to FIG. 37, a flow chart illustrates one method for manufacturing the headcover 100. At block 1300, forming a headcover body 1202 defining a belly panel 1204, a first side panel 1208, a second side panel 1208, and a top panel 1210 that collectively define an interior portion 1228. At block 1302, forming a plurality of collapsible portions 1212 along the headcover body 1202, wherein each of the collapsible portions 1212 deforms to allow the headcover body 1202 to be configured between a non-collapsed configuration and a collapsed configuration. At block 1304, applying an external force to the headcover body 1202 such that at least one of the plurality of collapsible portions 1212 forms a crease as the headcover 1202 is configured from a non-collapsed configuration to a collapsed configuration.

While a particular order of actions is illustrated in FIG. 37, these actions may be performed in other temporal sequences. For example, two or more actions depicted in FIG. 37 may be performed sequentially, concurrently, or simultaneously. Alternatively, two or more actions depicted may be performed in reverse order. Further one or more actions in FIG. 37 may not be performed at all. The apparatus, methods, and articles of manufacture described herein are not limited in this regard.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A headcover comprising:

a headcover body comprising:

a belly panel, a first side panel, a second side panel, and a top panel that collectively define an interior portion configured to receive a club head of a golf club;

a detachable pull strap defining a pull strap body forming a plurality of leg portions; and a plurality of fasteners, each of the plurality of fasteners including an attaching unit configured to be engaged to a closure unit when securing the detachable pull strap to the headcover body, wherein the attaching unit is located on the pull strap and the closure unit is located on the headcover body.

2. The headcover of claim 1, wherein each of the plurality of fasteners comprises an attaching unit configured to be engaged or disengaged from a closure unit when attaching or detaching the pull strap from or to the headcover body.

3. The headcover of claim 1, wherein each of the plurality of fasteners comprises an attaching unit configured to be engaged or disengaged from a closure unit when attaching or detaching the pull strap from or to the headcover body, wherein each respective attaching unit is disposed on the pull strap and each respective closure unit is disposed on the headcover body.

4. The headcover of claim 1, wherein the plurality of fasteners comprises a first fastener, a second fastener, and a third fastener.

5. The headcover of claim 1, wherein the plurality of fasteners comprises one of a plurality of snap fasteners, a plurality of two-part clip fasteners, a plurality of hook and loop fasteners, a plurality of webbing extensions, or a plurality of loop clip fasteners.

* * * * *